US011280104B2

(12) United States Patent
Gonzalez

(10) Patent No.: US 11,280,104 B2
(45) Date of Patent: Mar. 22, 2022

(54) SELF-ANCHORING SYSTEMS AND METHODS

(71) Applicant: Sandeezy, LLC, South Padre Island, TX (US)

(72) Inventor: Michael A. Gonzalez, South Padre Island, TX (US)

(73) Assignee: Sandeezy LLC, South Padre Island, TX (US)

( * ) Notice: Subject to any disclaimer, the term of this patent is extended or adjusted under 35 U.S.C. 154(b) by 215 days.

(21) Appl. No.: 16/791,826

(22) Filed: Feb. 14, 2020

(65) Prior Publication Data

US 2020/0181932 A1 Jun. 11, 2020

Related U.S. Application Data

(63) Continuation-in-part of application No. 15/872,923, filed on Jan. 16, 2018, now Pat. No. 10,711,480.

(60) Provisional application No. 62/807,707, filed on Feb. 19, 2019, provisional application No. 62/524,474, filed on Jun. 24, 2017.

(51) Int. Cl.

| | |
|---|---|
| ***A47B 91/00*** | (2006.01) |
| ***E04H 12/22*** | (2006.01) |
| ***A45B 23/00*** | (2006.01) |

(52) U.S. Cl.

CPC ..... *E04H 12/2215* (2013.01); *A45B 23/00* (2013.01); *E04H 12/2246* (2013.01); *A45B 2023/0012* (2013.01)

(58) Field of Classification Search

CPC . E04H 12/2215; E04H 12/2246; A45B 23/00; A45B 2023/0012

USPC ..... 248/508, 507, 156, 351, 346.02; 135/15.1, 16, 37; 52/155, 157

See application file for complete search history.

(56) References Cited

U.S. PATENT DOCUMENTS

| | | | | |
|---|---|---|---|---|
| 10,089,906 | B2 * | 10/2018 | Warnes | G09F 19/228 |
| 10,711,480 | B2 * | 7/2020 | Gonzalez | E04H 12/2246 |
| 2016/0333603 | A1 * | 11/2016 | Knudsen | G01B 5/14 |

* cited by examiner

*Primary Examiner* — Todd M Epps

(74) *Attorney, Agent, or Firm* — Norton Rose Fulbright US LLP

(57) ABSTRACT

A device is disclosed for facilitating the anchoring and release of a structure to a medium, such as sand. The device is operable to inject a liquefying fluid into a medium upon a down stroke so as to facilitate liquefication within an area of the medium. The structure is simultaneously inserted into the area of the medium where liquefication has occurred by creating a vacuum within the structure, upon an upstroke, which facilitates the insertion operation. The distal end of the structure to be anchored is fitted with at least one protrusion for increasing the holding force of the medium. If desired, the distal end of the structure is also fitted with at least one fin operable under selective control of a user for reducing the holding force on the structure. In one embodiment, the user, when desiring to release the structure, rotates the structure, thereby rotating the fin. The fin, rotating within the liquefied medium, serves to reduce the holding force of the medium with respect to the structure, thereby allowing for easier removal of the structure by a user.

20 Claims, 22 Drawing Sheets

SELF-ANCHORING SYSTEMS AND METHODS

CROSS REFERENCE TO RELATED APPLICATIONS

The present application claims priority to U.S. Provisional Application No. 62/807,707 filed Feb. 19, 2019 and entitled "SELF-ANCHORING SYSTEMS AND METHODS," and is a continuation in part of U.S. patent application Ser. No. 15/872,923, filed Jan. 16, 2018 and entitled "SELF-ANCHORING SYSTEMS AND METHODS," which claims the benefit of U.S. Provisional Patent Application No. 62/524,474 filed Jun. 24, 2017 and entitled "SELF-ANCHORING UMBRELLA," the disclosures of which are incorporated by reference herein in their entirety.

TECHNICAL FIELD

This invention relates to devices and methods for securing a structure in a medium using self-anchoring systems and methods employing liquefication techniques. The invention further relates to systems and methods for increasing a holding power of the medium and/or providing means for controllably decreasing the medium's holding power.

BACKGROUND

There are many situations where it is desired to securely anchor or affix a structure onto a particular medium. In typical cases, this may be attempted by displacing material from an area of the medium to facilitate insertion of the structure into the displaced area of the medium. For example, beachgoers may desire to setup a structure, such as an umbrella, a volleyball net, a fishing rod holder, etc., in the sand. In the case of an umbrella, the beachgoer may desire to securely anchor the umbrella to the sand so that the umbrella may stand upright and may withstand wind forces. Depending on the particular design of the umbrella, securing the umbrella may require inserting a lower portion of the umbrella stand, which is typically an elongated tube structure, into the sand. However, inserting the lower portion of the umbrella stand into the sand may present unique challenges.

For example, the beachgoer may simply attempt to push the lower portion of the umbrella stand into the sand by sheer force. If the sand is soft enough to accept the umbrella base, the lower portion may be inserted in to the sand with ease. However, because the sand is soft, the sand may not be able to provide adequate anchoring strength. The sand may simply separate when pressure, such as wind pressure, is exerted on the umbrella and the umbrella may fall over, or worse, may become a potentially dangerous flying object.

On the other hand, when the sand is hard enough to potentially secure the umbrella despite the wind pressure, then it may be difficult to push the base into the sand. In this case, the beachgoer may use a different approach than simply pushing the base onto the sand. For example, the beachgoer may affix the umbrella stand to the sand by digging a hole in the sand, placing the lower portion of the umbrella stand in the hole, and then filling the hole with the previously removed sand around the umbrella stand. However, in this case, the displacement of the sand caused by digging the hole compromises the ability of the sand to provide lateral support because the sand is no longer compacted. Even when the beachgoer manually compacts the sand around the stand, such as by tamping the sand repeatedly, the movement of the base as the umbrella is subjected to wind forces causes the sand to become "uncompacted" and lose anchoring strength.

Another approach a beachgoer may use to secure the umbrella stand onto the sand may include using a beach anchor having a screw base. The screw base is screwed onto the sand providing an anchor for the umbrella stand. However, screwing the base onto the sand requires significant strength, especially when the sand is not very soft. Additionally, the screw base disturbs a significant amount of sand from the anchoring area compromising the anchoring strength of the sand, as discussed above.

The above-identified Patent Application describes systems and methods for using liquefication injected into the holding medium, such as into sand, for holding a structure, such as a beach umbrella, tent, fishing rods and the like. The systems and methods described work well and are a great improvement from what existed before the advent of the liquefication system and method disclosed therein. However, in some situations it is desired for the medium to have even an even greater holding power than is afforded by the systems and methods taught in the above-identified Patent Application.

In any attempt to increase the holding force of the medium, two problems must be overcome simultaneously. The first of these problems deals with the actual mechanism of enhancing the holding force on a structure inserted into a medium using the systems and methods described in the above-identified patent application and the second problem deals with the problem of subsequently removing a structure from the medium when enhanced holding forces have been applied. This problem stems from the fact that upwards of a hundred pounds of force (and often even greater) may be desirable to hold some structures. When that amount of holding force is employed, it is very difficult, and for some people, practically impossible, to remove a structure from the medium.

SUMMARY

The present invention is directed to apparatuses, systems, and methods which provide anchoring systems for securing a structure onto a medium using a liquefication technique. For example, anchoring systems of embodiments provide features that allow for a structure to be securely anchored into a medium by causing liquefication with respect to the medium, inserting the structure into an area of liquefication with respect to the medium, and creating at least a partial vacuum that is applied to the liquefied area of the medium, thereby creating a secure anchor for the structure. In other words, the at least partial vacuuming of the liquefied medium facilitates generating a holding force of the medium on the structure; the holding force of the medium facilitates creating a secured anchor for the structure.

The anchoring systems described herein may be designed to enhance the holding force of the medium. In one embodiment, a portion of the structure to be held in the medium may be fitted with a media interface boss, such as formed by a cap or other protuberance, that provides a ledge on the outer surface of the portion of the structure. The presence of the ledge according to embodiments of the invention enhances the holding force of the medium on the structure as compared to a holding force experienced by a structure that does not have a media interface boss (e.g., cap) disposed on a portion of the structure to be held in that medium.

In some embodiments, a protruding member, such formed by a fin, a bolt, or other protuberance, may be provided with respect to a portion of the structure of an anchoring system to be held in the medium. The protruding member, according to the embodiments of the invention, is configured for facilitating removal of the anchoring system from the medium. The protruding member may extend away from a side of the anchoring system (or some portion thereof, such as the aforementioned the cap) so as to be employed to reduce the holding force of the medium when removing the structure from an anchored state. For example, when a user intends to remove the structure from the medium, the user may rotate the structure in a particular direction (e.g., counter-clockwise), which rotates the protruding member in the same direction in the partially vacuumed medium. The movement of the protruding member in the partially vacuumed medium breaks (e.g., reduces) the holding force of the medium on the structure.

In some embodiments, a media interface boss for enhancing the holding force of the medium and a protruding member for facilitating removal of the anchoring system from the medium may be provided as part of a common host structure. For example, a cap may be designed to both include the protruding member and to form a ledge on the outer surface of the portion of the structure after fitting the cap to the portion of the structure to be held in the medium.

It is noted that as used herein, liquefication with respect to a medium may refer to the saturation of at least an area of the medium with a liquefying fluid, which causes the medium within the saturated area of the medium to lose strength, to become softer, and to behave with characteristics of a liquid. For example, in some embodiments, the medium may be sand and the liquefying fluid may be water. Liquefication with respect to the medium, a used herein, may refer to the effect of the sand becoming less firm, softer, wherein the bonds between the sand particles are weakened, and the sand behaving with characteristics of a liquid when the sand becomes saturated with water. Thus, as liquefication with respect to the sand occurs, the sand within the area of liquefication is softened and more malleable. In some examples, sand in the area of liquefication effectively behaves as quicksand behaves. It should also be noted that in embodiments, the medium may be any kind of medium (e.g., sand, soil, particulate materials, composite materials, wallboard, etc.) that is susceptible to liquefication in response to saturation with liquefying fluid. In embodiments, the liquefying fluid may be any appropriate substance (e.g., water, a solvent that works on certain materials, etc.) able to saturate the medium and cause liquefication with respect to the medium.

The anchoring system of embodiments may allow for a structure, such as a hollow tube structure of a stand, to be easily inserted into a medium by using a liquefying fluid, which may be held internal to the tube structure, and gently injecting the liquefying fluid into the medium to cause liquefication with respect to the medium. As noted above, in some embodiments, the medium may be sand and the liquefying fluid may be water. In this case, causing liquefication with respect to the sand may allow sand in the area of liquefication to be drawn into the hollow area of the tube structure by a vacuum created by suction, while the tube structure is oppositely drawn into the sand. It is noted that in some embodiments, the vacuum includes at least a partial vacuum. The vacuum may provide a compacting force to the area of liquefication that ensures the structure is securely anchored into the medium and counteracts forces to which the structure may be subjected. In some embodiments, once the tube structure is inserted into the medium using liquefication techniques, the liquefying fluid may be removed from the area of liquefication and the medium may be compacted (e.g., may stiffen or become hard again), thereby providing an anchoring or holding force. In some embodiments, the liquefying fluid may be removed from the area of liquefication by percolation, filtration, leaking, etc., of the liquefying fluid through the medium.

In embodiments, a plunger assembly that includes a piston may be positioned internal to the tube structure and may be operated by a rod connected to the piston and extending out from the top of the tube structure. In embodiments, plunger assembly 10 may be constructed as one or two pieces of polypropylene plastic using an injection mold process. In some embodiments, the plunger assembly may include a handle positioned at the top of the rod. The plunger assembly may act as a valve for creating the vacuuming to draw the liquefying fluid and/or the medium material into the tube structure. For example, in embodiments, during operation, the liquefying fluid may be drawn into the tube structure by bringing the bottom area of the tube structure with the plunger assembly inside into contact with water, and then pulling the plunger assembly in an upward direction creating a vacuum within the tube structure. The vacuum may cause the liquefying fluid to be drawn into the tube structure. A tight fit between the outer periphery of the piston and the inner walls of the tube structure in Which the plunger assembly is positioned may ensure an adequate seal to create and/or maintain the vacuum within the tube structure, and may allow the plunger to act as a valve and essentially hold the drawn water in place.

The open end of the tube structure may then be positioned on the medium in a desired location and the plunger assembly may be pushed downward toward the medium. The force created by the plunger assembly may force the liquefying fluid within the tube structure to be injected into the medium. The liquefying fluid may saturate the medium and create an area of liquefication, causing the medium in the area of liquefication to become softer, less stiff. The plunger may then be pulled upward, creating a vacuum that draws at least a portion of medium within the area of liquefication into the hollow tube structure, while the tube structure may be pushed downward into the medium, causing the medium within the area of liquefication to be displaced such that the tube structure is easily inserted into the medium, thereby facilitating the movement of the tube structure into the void left by the displaced medium.

It is noted that as the medium within the area of liquefication is drawn up into the hollow area of the tube structure as the tube structure is inserted into the medium, a minimal amount of medium is actually displaced and/or disturbed, which ensures that the anchoring strength of the medium is minimally affected.

The handle of the plunger may extend above the top end of the tube structure. In some embodiments, the handle may be configured to be folded, or otherwise positioned to have a diameter smaller than the inner diameter of a second tube to be mated with the tube structure. In some embodiments, the handle may be configured to have a diameter smaller than the inner diameter of the second tube. In these embodiments, the second tube may be mated to the tube structure by slipping the second tube over the handle until it is mated with the tube structure. In some embodiments, the second tube mates with the tube structure by slipping inside the tube structure and releasably locking to the tube structure. In other embodiments, the second tube mates with the tube structure by slipping outside the tube structure and releasably locking to the tube structure.

In some cases, the second tube may not be able to slip over the handle of the plunger assembly to mate with the tube structure. For example, the second tube may not be hollow. In some embodiments, the handle of the plunger assembly may be removable from the piston to accommodate mating the second tube with the tube structure in these cases. In this case, the handle may be removed from the piston, and from the tube structure, allowing the second tube to mate with the tube structure. Additionally, removing the handle from the piston allows the piston to remain within the tube structure and to maintain a seal between the piston and the inner wall of the tube structure.

The foregoing has outlined rather broadly the features and technical advantages of the present invention in order that the detailed description that follows may be better understood. Additional features and advantages will be described hereinafter which form the subject of the claims. It should be appreciated by those skilled in the art that the conception and specific embodiment disclosed may be readily utilized as a basis for modifying or designing other structures for carrying out the same purposes of the present application. It should also be realized by those skilled in the art that such equivalent constructions do not depart from the spirit and scope of the application as set forth in the appended claims. The novel features which are believed to be characteristic of embodiments described herein, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present embodiments.

BRIEF DESCRIPTION OF THE DRAWING

For a more complete understanding of the disclosed methods and apparatuses, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

It is noted that the discussion that follows is primarily made with respect to a beach umbrella being set up in the sand. However, it should be understood that the solutions disclosed herein should not be read to be limited to setting up a beach umbrella in the sand, but should be understood to be equally applicable to any structure and medium where the self-anchoring systems and methods using medium liquefication techniques discussed may be used. For example, the solutions disclosed herein should be understood to be equally applicable to setting up a volleyball net, a fishing rod holder, a canopy, a flag pole, a badminton net, a tent stake, etc.

Figure 1A:
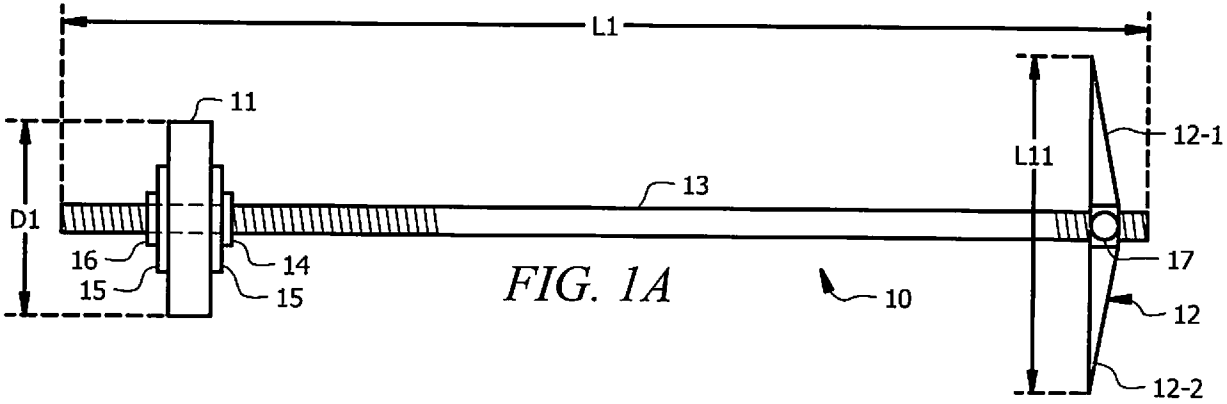
FIG. 1A shows an embodiment of a plunger mechanism used for drawing water and sand into a hollow structure.

FIG. 1A shows plunger mechanism 10 which, in one embodiment, comprises piston 11 connected to handle 12 by rod 13. In the embodiment shown, rod 13 may be a threaded rod with washer 15 and nuts 14 and 16 holding piston 11 in a relatively fixed position with respect to handle 12. Handle 12, in this embodiment, may be a toggle bolt anchor such that handle 12 may be screwed onto rod 13 to a desired position and if desired locked into that position by any means desired such as nuts below and above the handle. Portions 12-1 and 12-2 of handle 12 can be folded down along rod 13 by hinges 17. Handle 12 may be spring loaded so that it will remain in the open (unfolded) position unless force is applied to fold it down against rod 13. When other materials are used to form handle 12, then other hinge means, such as plastic, may be used.

Figure 1B:
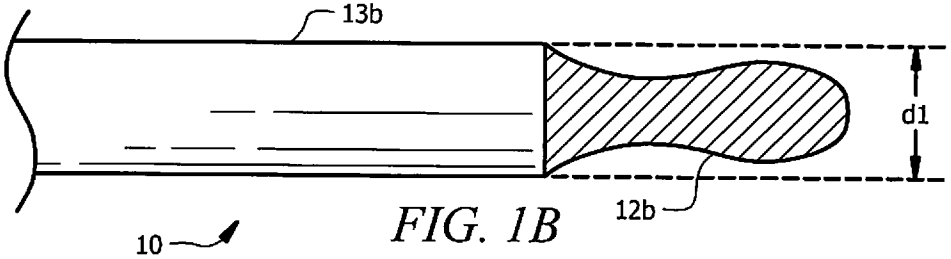
FIG. 1B shows an embodiment of a handle assembly.

FIG. 1B shows an alternate embodiment of a plunger mechanism 10 with handle 12*b* and shaft 13*b*. In this embodiment, handle 12*b* may have a shape to facilitate gripping the handle. Additionally, handle 12*b* and shaft 13*b* may be configured to have a size that allows a hollow upper portion, such as upper portion 41 of umbrella assembly 40 shown in FIG. 9, to slide over handle 12*b* and shaft 13*b* during operation. In this embodiment, handle 12*b* and shaft 13*b* may have a diameter d1 that is smaller than the hollow upper portion. In some embodiments, the diameter d1 of handle 12*b* and shaft 13*b* assembly may be determined by the size of the upper portion. For example, in some embodiments, handle 12*b* and shaft 13*b* may have a diameter d' between 5 mm and 110 mm.

With reference again to FIG. 1A, rod 13 may have length L1. In some embodiments, length L1 may have a nominal value between 28-60 inches, and may have a nominal diameter between of 5-110 mm. In some implementations, the value of length L1 may depend on the particular application of the device. Additionally, length L1 may depend on the length L2 of lower portion 20 of an umbrella assembly, shown in FIG. 2A and FIG. 9. L1 may be longer than L2 such that handle 12 extends outside of distal end 23 of lower portion 20. For example, L1 may be at least 1 inch longer than L2, such that handle 12 extends outside of distal end 23 of lower portion 20, shown in FIG. 2A. In some embodiments, length L1 may be smaller than length L2.

Figure 2A:
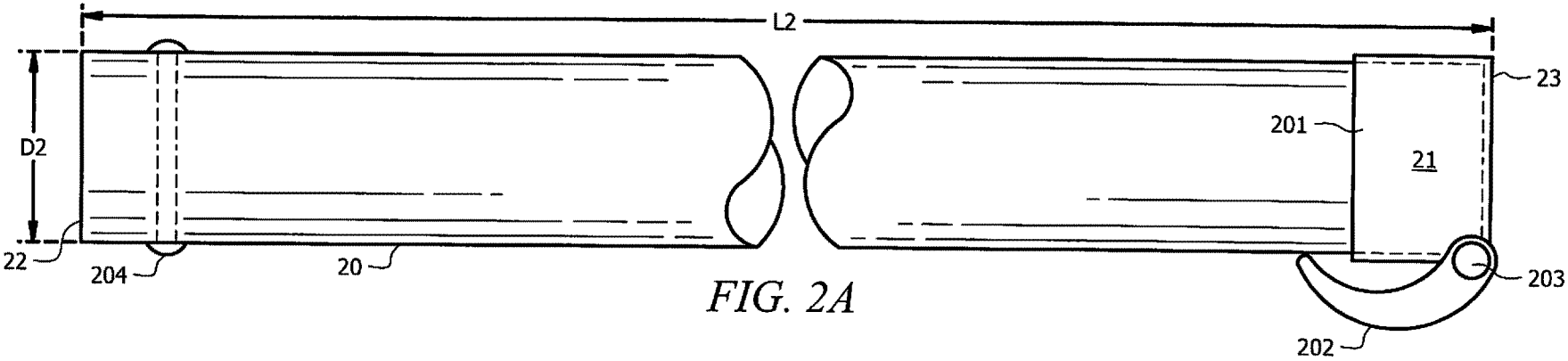
FIG. 2A shows an embodiment of a hollow structure into which the plunger of FIG. 1A) can be placed.
Figure 2B:
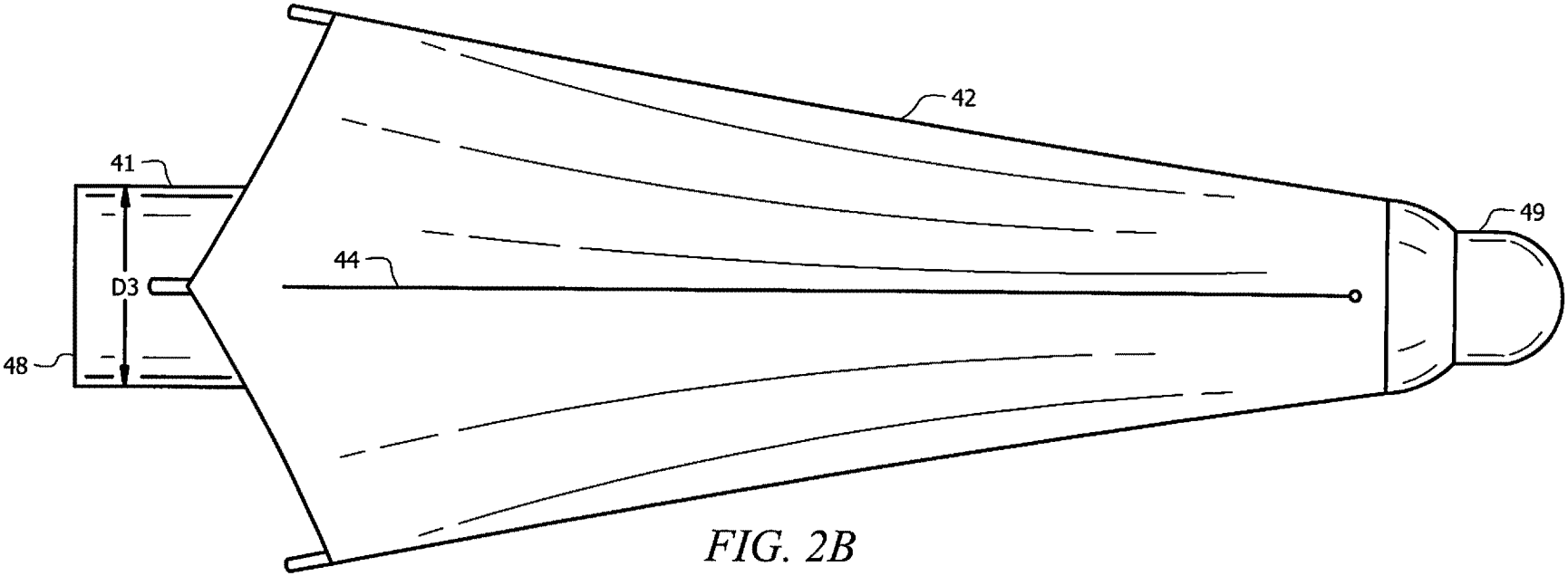
FIG. 2B shows an embodiment of a hollow structure with the umbrella canopy.

Plunger mechanism 10 may be configured to operate, as described in further detail below, in cooperation with a lower portion of a structure assembly to provide the self-anchoring features described herein. For example, plunger mechanism 10 may cooperatively operate with lower portion 20 of an umbrella assembly, shown in FIG. 2A and FIG. 9. Therefore, in some embodiments, piston 11 may be configured to be coextensive with lower portion 20. As used herein, a piston coextensive with a lower portion may refer to the piston having a shape and size corresponding to the lower portion such that piston 11 fits snuggly within lower portion 20 and may frictionally slide within section 20 without significant binding, and such that the liquefying fluid may not easily pass between the outer boundaries of piston 11 and the inner wall of lower portion 20. Thus, in embodiments, the outer periphery of piston 11, also referred to as an outer diameter, may be round to match a round inner periphery, also referred to as inner diameter, of lower portion 20. In the embodiment shown, the round outer periphery of piston 11 may have a nominal diameter D1. In some aspects, diameter D1 may be a value between 5 mm and 110 mm. Correspondingly, as shown in FIGS. 2A and 2B, lower portion 20 of the umbrella assembly may have a round cross-section with inner diameter D2. In aspects, diameter D2 may have a value between 5 mm and 110 mm.

With reference to FIG. 2A, lower portion 20 may have a hollow cylindrical shape, such as that of a tube or pipe, to accommodate plunger mechanism 10. Lower portion 20 may be constructed from any rigid material such as plastic, PVC, metal, or the like. As noted above, the exact diameter D1 of piston 11 may depend on inner diameter D2 of lower portion 20. In some embodiments, once inner diameter D2 of lower portion 20 is determined, then diameter D1 of piston 11 may be adjusted accordingly to form a snug fit such that piston 11 may frictionally slide within section 20 without significant binding and such that the liquefying fluid (as will be discussed hereinafter) will not easily pass between the outer boundaries of piston 11 and the inner wall of lower portion 20.

In some embodiments, as the liquefying fluid may be salt water, the inner wall of lower portion 20 may be configured to resist oxidation and/or corrosion. In some aspects, lower portion 20 may be made of non-oxidizing materials such as a PVC, plastic, fiberglass, stainless steel, aluminum, etc. Alternatively, or additionally, the inner wall of lower portion 20 may be covered with a protection agent such as paint, or other protection. Still in some embodiments, a sleeve may be used within lower portion 20 to prevent the salt water from making contact with the inner wall of lower portion 20.

In embodiments, proximal end 22 of lower portion 20 is open so that the liquefying fluid and the medium material may freely flow into lower portion 20 via proximal end 22, as will be discussed in further detail hereinafter. It is noted that lower portion 20 may be manufactured with a pointed end (not shown) to facilitate inserting lower portion 20 into the medium. In embodiments, the pointed end (not shown) may be removable. In some embodiments it may be desirable to provide a mechanism for preventing piston 11 from exiting proximal end 22 during operation. Such mechanism may include pin 204, which may be configured as a stop for piston 11 when piston 11 is pushed toward proximal end 22 during operation. In some embodiments, the stopping mechanism may include a rivet, dimple, bump, tab, a ring, or other protuberance within lower portion 20 near the proximal end. In some implementations, a stopping mechanism as discussed above may be additionally or alternatively included for preventing piston 11 from exiting distal end 23 during operation.

In some embodiments, distal end 23 of lower portion 20 may have a locking mechanism, such as lock mechanism 21, to securely affix proximal end 48 of an upper portion 41 (shown in FIG. 9) into a releasably mated relationship with lower portion 20. Typically, lock mechanism 21 may contain portion 201, which may be positioned around the outer dimension of lower portion 20, thereby allowing upper portion 41 to slip inside lower portion 20. Upper portion 41 may have a diameter D3. In these embodiments, diameter D2 of lower portion 20 may be larger than diameter D3 of upper portion 41. Upon operation of lever 202, which pivots around pin 203, mechanism 21 may apply inward pressure on mated lower portion 20 and upper portion 41 thereby releasably locking lower portion 20 and upper portion 41 together along their elongated axis so as to form a taller structure for holding an object, such as an umbrella as will be discussed hereinafter.

With reference again to FIG. 1A, piston 11 may be made from different materials depending on the application. For example, piston 11 may be made from cork, rubber, plastic, or any material that is not easily dissolvable by the liquefying fluid. In some cases, the liquefying fluid may be water, which may be fresh water or sea water, and piston 11 may be made from a material that is not easily dissolvable in water. In embodiments, as further discussed below, piston 11 may be made from a hard or rigid material (e.g., plastic or metal) and may include a sealing material (e.g., an o-ring or square seal made from plastic, rubber, elastic polymers, cork, leather, etc.) around the piston's outer periphery.

In some embodiments, piston 11 may be configured to be removable from plunger mechanism 10 to facilitate applications where upper portion 41 may not be hollow. In this case, leaving plunger mechanism 10 inside lower portion 20 after anchoring into the medium may prevent upper portion 41 from mating with lower portion 20, as upper portion 41 may not be able to slip around handle 12 and rod 13 of plunger mechanism 10. In these embodiments, plunger mechanism 10 may configured to be removable from piston 11, such that handle 12 and rod 13 may be removed from lower portion 20 and piston 11 may remain within lower portion 20. It is noted that allowing piston 11 to remain within lower portion 20 after lower portion has been anchored into the medium, in accordance with the techniques discussed herein, may help in maintaining a vacuum within lower portion 20, which may provide additional compacting forces increasing the anchoring strength of the medium.

Figure 1C:
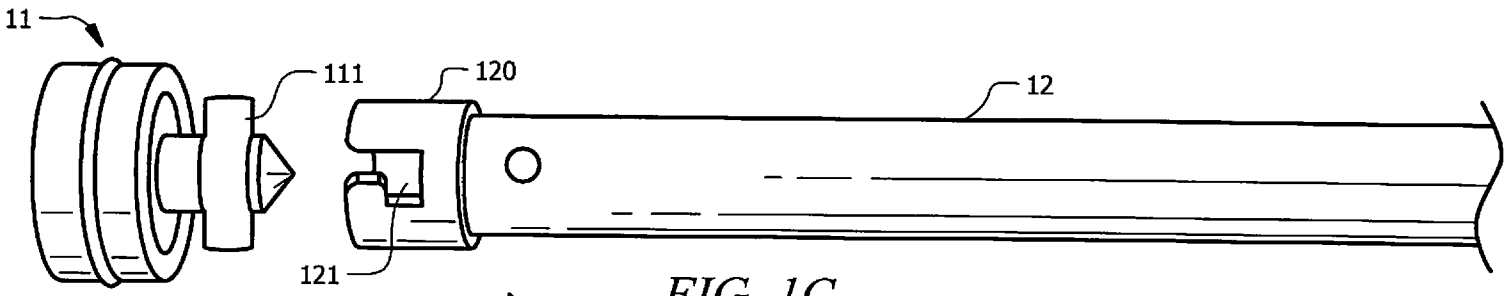
FIG. 1C shows an embodiment of a plunger assembly with a removable piston.
Figure 1D:
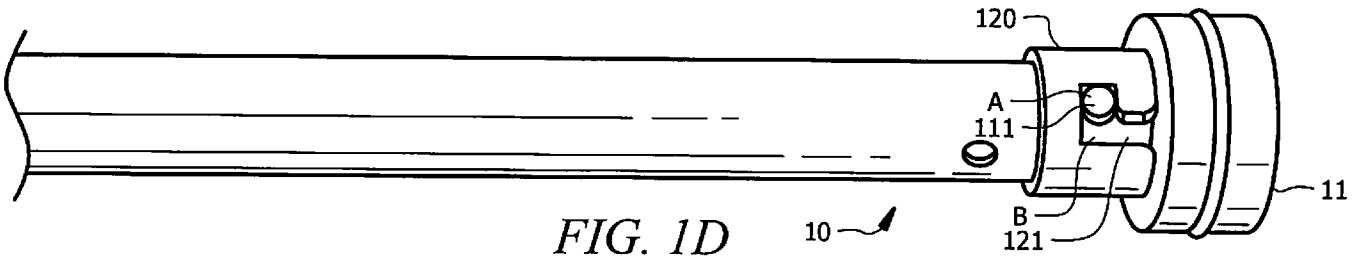
FIG. 1D shows another view of the embodiment of the plunger assembly with a removable piston.

FIG. 1C shows an embodiment of plunger mechanism 10 with piston 11 providing a removable handle configuration. The removable mechanism may include female connector 120 and male connector tab 111. Female connector 120 and male connector tab 111 may be configured to releasably mate with one another. In some embodiments, female connector may include groove 121 which may receive male connector tab 111. Groove 121 may be configured as an L-shaped groove, such that when male connector tab 111 is inserted into female connector 120 and rotated, a portion of the L-shaped groove secures the male connector tab 111. FIG. 1D shows a locked configuration of piston 11 and shaft 13. As shown, male connector tab 111 has been inserted into female connector 120 and rotated to position A, such that male connector tab 111 is prevented from decoupling from female connector 120 by L-shaped groove 121. In some embodiments, groove 121 may include a protuberance, such as a dimple, bump, dent, etc., configured to make contact with connector tab 111 such that when piston 11 is rotated within groove 121, male connector tab 111 and groove 121 snap together, providing physical feedback to a user that piston 11 has been coupled to (or decoupled from as discussed below) plunger mechanism 10. Piston 11 may be removed from plunger mechanism 10 by rotating plunger mechanism 10, which rotates male connector tab 111 clockwise to position B of the L-shaped groove 121, allowing the plunger mechanism 10 to decouple from piston 11. In some embodiments, during the decoupling operation, plunger mechanism 10 may be rotated clockwise or counter-clockwise to decouple plunger mechanism 10 from piston 11.

Figure 1E:
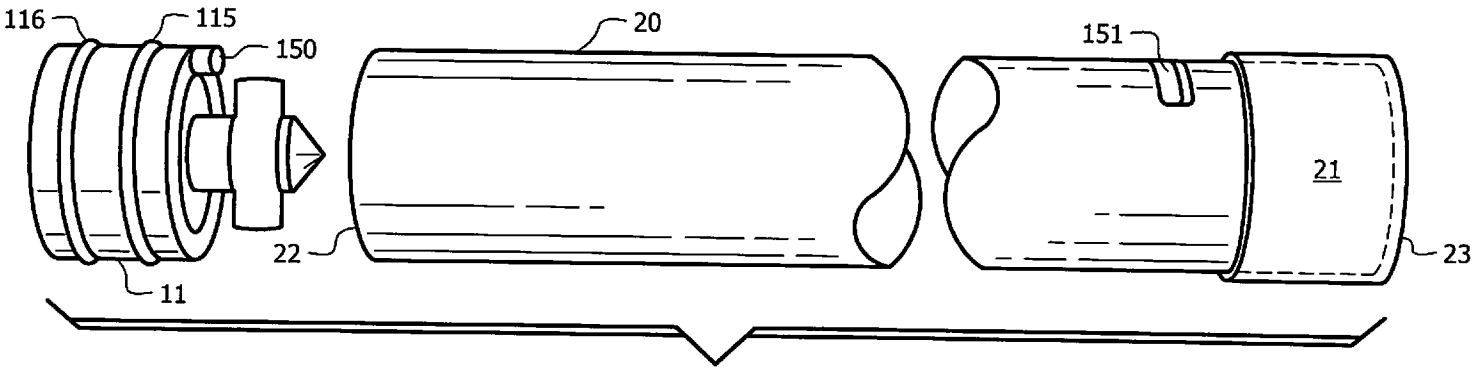
FIG. 1E shows yet another view of the embodiment of the plunger assembly with a removable piston.

In some aspects, plunger mechanism 10 may rotate with respect to removable piston 11 due to resistance due to friction between piston 11 and the inner wall of lower portion 20. The resistance allows plunger mechanism 10 to rotate while piston 11 remains fixed. In some embodiments, as shown in FIG. 1E, piston 11 may be configured with tab 150 configured to provide additional resistance to facilitate decoupling of piston 11 from plunger mechanism 10. A corresponding rivet 151 may be provided in the inner wall of lower portion 20. In operation, tab 150 of piston 11 and rivet 151 of lower portion 20 may make contact and piston 11 may be prevented from rotating while plunger mechanism 10 is allowed to rotate. As such, plunger mechanism 10 may be allowed to separate as described above. In some embodiments, rivet 151 may be installed near distal end 23, as plunger mechanism 10 may be decoupled from removable piston when the plunger has been pulled upward toward distal end 23 during operation in order to create a vacuum within lower portion 20, as will be described in further detail below.

Figure 1F:
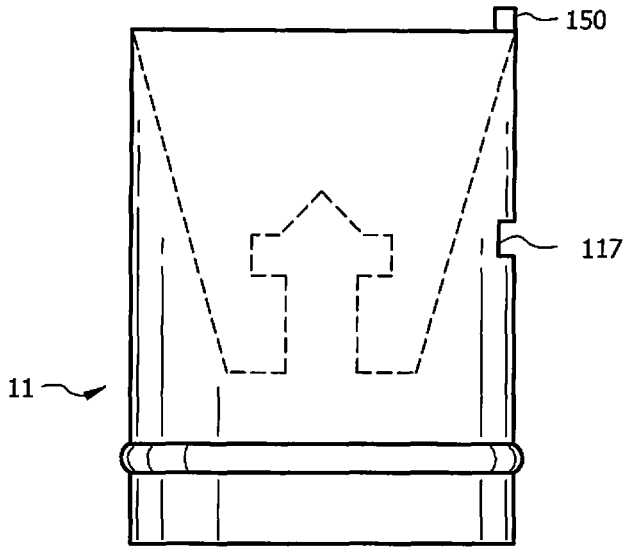
FIG. 1F shows an embodiment of a removable piston.

In some embodiments, as shown in FIG. 1F, piston 11 may configured with a coned-shaped fin 117 to facilitate applications in which lower portion 20 may have a large inner diameter D2. As the inner diameter D2 of lower portion 20 increases, the length of piston 11 may be configured to ensure that piston 11 is kept from rotating within lower portion 20 and is maintained parallel with the lower portion 20. For example, for an inner diameter D2 of 20 mm, piston 11 may have a length of 15 mm, for an inner diameter D2 of 30 mm, piston 11 may have a length of 15 mm, and for an inner diameter D2 of 35 mm, piston 11 may have a length of 18 mm. To that end, the length of piston 11 may be increased by including cone shaped fin 117 to piston 11. The additional length may help to maintain piston 11 parallel to lower portion 20 by preventing piston 11 from rotating within lower portion 20, as cone-shaped fin may provide resistance with respect to the inner walls of lower portion 20, to rotation of piston 11. In additional or alternative embodiments, piston 11 may be maintained parallel with the lower portion 20 and kept from rotating within lower portion 20 using a tab or protrusion. In some embodiments, the tab may be included in the proximal end piston 11, the distal end of piston 11, or both ends of piston 11.

Additionally, cone-shaped fin 117 may also facilitate coupling of female connector 120 and male connector tab 111. In aspects, cone-shaped fin 117 may be positioned around male connector tab 111 on piston 11. During operation, cone-shaped fin 117 may guide female connector 120 toward male connector tab 111, thereby facilitating blind coupling of female connector 120 and male connector tab 111. In implementations with a cone-shaped fin, tab 150 may be positioned on the edge of cone-shaped fin 117.

In some embodiments, piston 11 may include at least one ring configured to facilitate a seal between piston 11 and the inner wall of lower portion 20 while allowing piston 11 to frictionally slide within lower portion 20 during operation. For example, piston 10 may include sealing ring 115, as shown in FIG. 1E. Sealing ring 115 may be an o-ring or a square cut seal, and may be made of plastic, rubber, elastic polymers, etc. Sealing ring 115 may be configured to contact the inner wall of lower portion 20 and provide a seal between piston 11 and the inner wall. In some embodiments, ring 115 may be self-lubricating and may reduce friction between piston 11 and the inner wall of lower portion 20 to facilitate piston 11 frictionally sliding within lower portion 20. In further embodiments, piston 11 may include cleaning ring 116. Cleaning ring 116 may be configured to clean the inner wall of lower portion 20 in order to prevent medium material from reaching sealing ring 115 and interfering with the seal. Cleaning ring 116 may be a brush type ring or a cleaning washer.

Figure 1G:
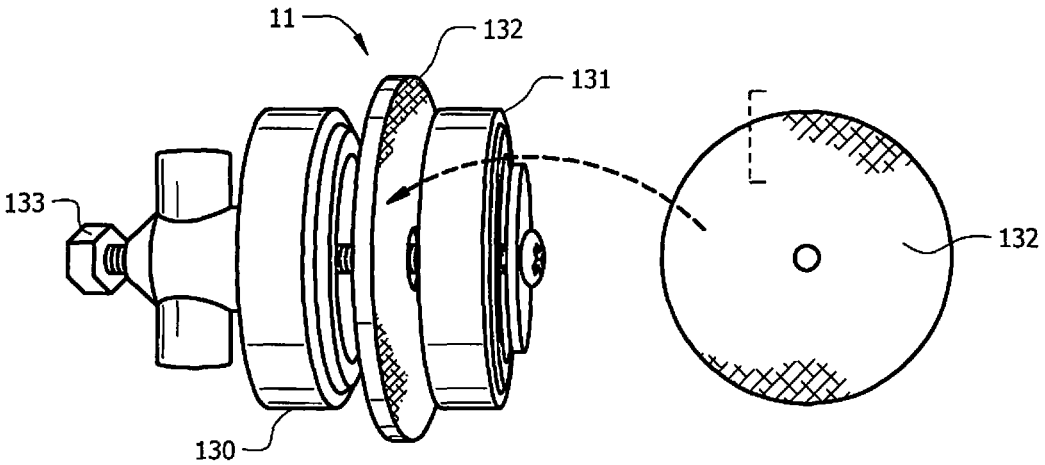
FIG. 1G shows an embodiment of a piston assembly.
Figure 1H:
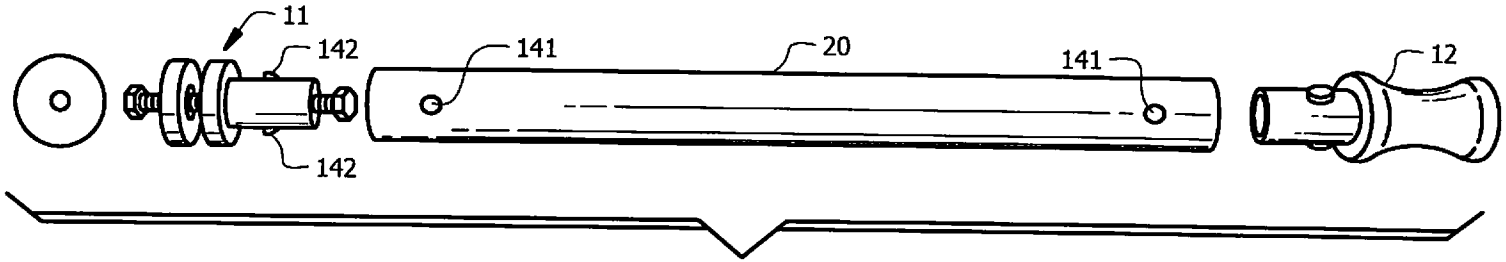
FIG. 1H shows a configuration of a plunger mechanism in accordance with aspects of the present disclosure.
Figure 1I:
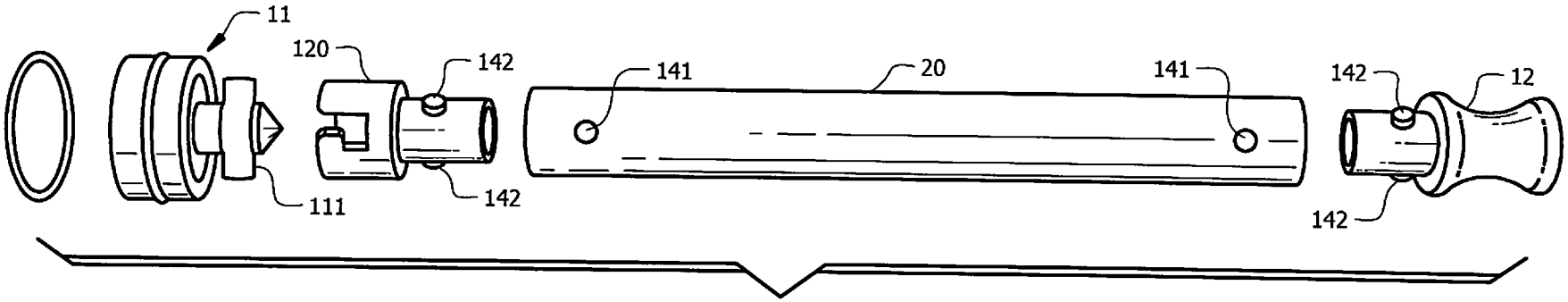
FIG. 1I shows another configuration of a plunger mechanism in accordance with aspects of the present disclosure.

FIG. 1G shows an embodiment of piston 11 configured to include lower component 130, upper component 131, seal 132, and fastener 133. In aspects, piston 11 may be configured to be assembled by mating lower component 130 with upper component 131, using fastener 133. In embodiments, fastener 133 may include a bolt and nut, a screw, a pin, a clamp, or any other means for fastening lower component 130 and upper component 131 together. Seal 132 may be a washer, gasket, liner, ring, etc., and may be made from plastic, rubber, elastic polymers, cork, leather, etc. In some aspects, seal 132 may be positioned between lower component 130 and upper component 131, such that seal 132 is sandwiched between lower component 130 and upper component 131, and held together by fastener 133. In some embodiments, fastener 133 screw head and nut configuration may be reversed as shown in FIG. 1H. In some embodiments, the outer circumference of seal 132 may protrude beyond the outer circumferences of lower component 130 and upper component 131 when sandwiched together, and thus may provide a functional equivalence to sealing ring 115 as discussed above. In some embodiments, the configuration of piston 11 may provide an alternative to employing an O-ring and/or a square ring seal, and may provide a superior hold of piston 11.

In some embodiments, as shown in FIG. 1H, plunger mechanism 10 may be assembled by assembling piston 11, rod 13, and handle 12. For example, in some embodiments, rod 13 may include at least one opening 141 configured to couple with a respective component, such as piston 11 and handle 12. In embodiments, piston 11 may include tab 142 configured to snap into opening 141 upon piston 11 being coupled to a respective end of rod 13, such that the snapping of tab 142 and opening 141 holds piston 11 and rod 13 together. Handle 12 may include at least one tab 142 configured to snap into a respective opening 141 of rod 13 upon handle 12 being coupled to a respective end of rod 13. The snapping of tab 142 and opening 141 may hold handle 12 and rod 13 together. FIG. 1 shows a similar assembly configuration of plunger mechanism 10 in accordance with the present disclosure. In aspects, once plunger mechanism 10 is assembled by coupling piston 11, rod 13, and handle 12 together, plunger mechanism 10 may be used during operations as discussed in further detail below. It should be recognized that these configurations of plunger mechanism 10 may provide advantages in manufacturing of the individual components. For example, in some embodiments, piston 11 and handle 12 may be manufactured using a mold, and rod 13 may consist of a typical hollow tube, which may result in lowering manufacturing costs.

FIG. 2B shows hollow upper structure portion 41 which holds umbrella canopy 42 in place with cap 49. Struts 44 are shown in their rested position when folded flat for storage. The open position of umbrella 42 will be discussed in more detail with respect to FIG. 9.

Figure 3:
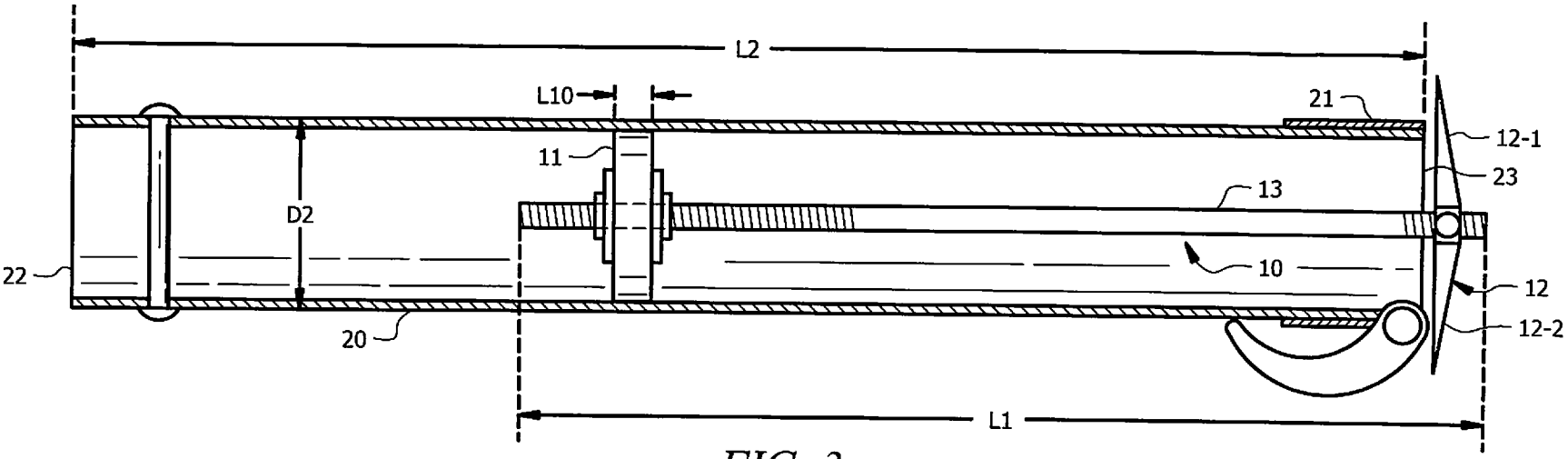
FIG. 3 shows the plunger of FIG. 1A positioned within the structure of FIG. 2A.

FIG. 3 shows an assembly configuration of the self-anchoring system of embodiments. During assembly, plunger mechanism 10 may be positioned within lower portion 20 of an umbrella assembly, such as umbrella assembly 40 shown in FIG. 9, with the periphery of piston 11 in frictional contact with the inner surface of lower portion 20. To assemble the self-anchoring system, handle sections 12-1 and 12-2 of handle 12 of plunger mechanism 10 (see FIG. 1A) may be folded down around shaft 13 and then positioned within proximal end 22 of lower portion 20. Plunger mechanism 10 may then be pushed through lower portion 20 until handle 12 emerges from distal end 23 and handle 12 springs open achieving the assembly configuration shown in FIG. 9. Once handle 12 is opened, plunger mechanism 10 may be prevented from being pushed through lower portion 20 during operation, as the unfolded handle sections 12-1 and 12-2 of handle 12 would contact distal end 23 preventing further movement into lower portion 20. Additionally, or alternatively, a stopping mechanism as discussed above (not shown), or a portion of lock mechanism 21 (not shown) may protrude into lower portion 20 so as to prevent piston 11 from exiting lower portion 20 via distal end 23. Thus, once plunger mechanism 10 is positioned within lower portion 20, it may remain in position and ready for use as will hereinafter be discussed.

In some embodiments, such as those in which plunger mechanism 10 is configured with handle 12*b* as shown in FIG. 1B, assembling the self-anchoring system of embodiments may be achieved by pushing plunger assembly 10 through distal end 23 toward proximal end 22 until plunger mechanism 10 reaches the bottom of lower portion 20. As discussed above, in some embodiments, a pin (not shown) or a portion of lock mechanism 21 (not shown) may protrude into lower portion 20 so as to prevent piston 11 from exiting lower portion 20 via distal end 23.

Operations of the self-anchoring system of embodiments for securing a structure onto a medium using a liquefication technique will now be discussed. It is noted that the discussion of operations that follows is primarily made with respect to anchoring a beach umbrella into sand. However, it should be understood that this discussion is made for illustrative purposes, and should not be understood to limit the present disclosure in any way.

Figure 4:
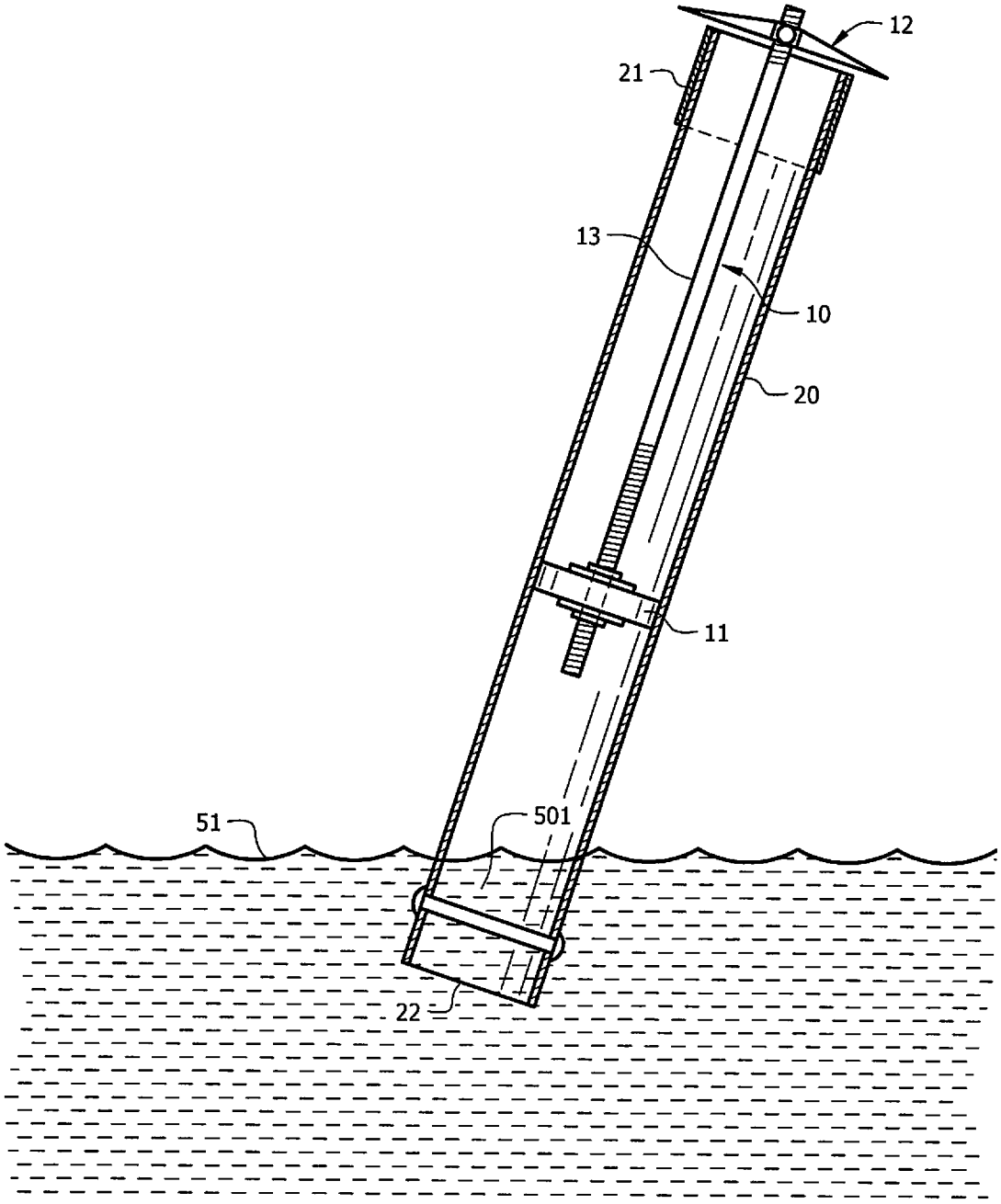
FIGS. 4 through 8 show the method of using the plunger mechanism of FIG. 1A to insert an umbrella stand into beach sand.
Figure 5:
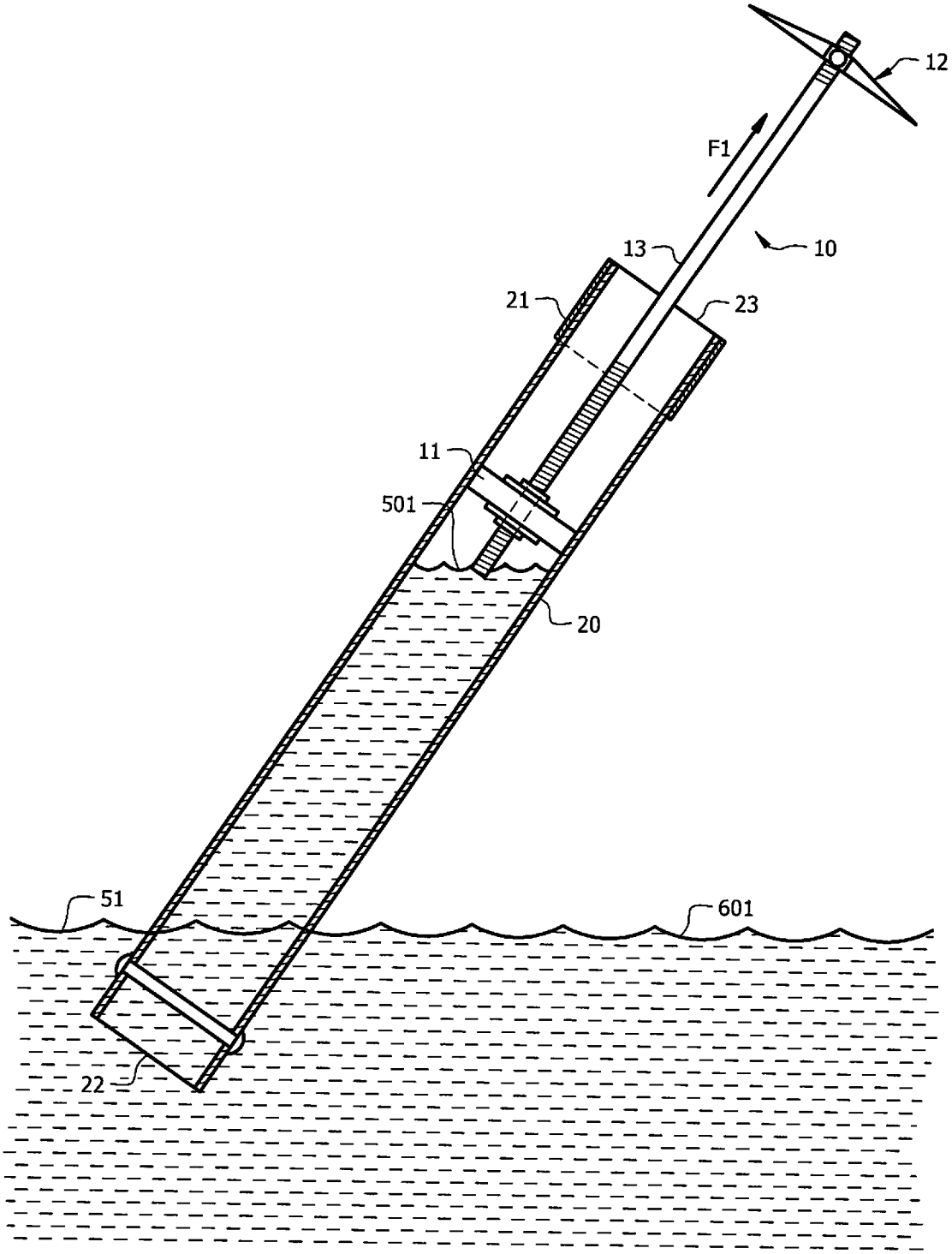

FIG. 4 shows lower portion 20 positioned for being filled with a liquefying fluid. For example, lower portion 20 may be filled with water 501 from a body of water, such as the Gulf of Mexico 51. FIG. 5 shows lower portion 20 being filled with the liquefying fluid. Plunger 10 may be pulled upward by upward force F1 applied to handle 12 while proximal end 22 of portion 20 is held below surface 601 of water 51. This operation creates a vacuum within lower portion 20, due to the seal between piston 11 and the inner wall of lower portion 20, which causes water 501 to move upward into lower portion 20. The entire structure may then be removed from the water source and transported to a desired location on the beach.

In alternate embodiments, lower portion 20 may be filled with the liquefying fluid by pouring the liquefying fluid into lower portion 20 via proximal end 22. In this case, the plunger assembly 10 may be first moved to the upward position so that there is space within lower portion 20 to contain the liquefying fluid, and then the liquefying fluid is poured into lower portion 20. In some situations, plunger assembly 13 could be removed from the top of lower portion 20 from distal end 23 and filled with water from the top, thereby not requiring hands to be placed under the distal end of the lower tube to hold in the water. This would also eliminate any need to wade into the water to vacuum up water. The user then would simply pick his/her spot, set the lower unit where desired, pull out the plunger from the top, fill the device with a liquid, such as water, insert the plunger in the lower unit and proceed to insert the device into the medium (sand or the like) and push the plunger down to create the liquefying effect as previously discussed.

In some cases, the vacuum, or partial vacuum, within lower portion 20 may keep water 501 from escaping lower portion 20 via proximal end 22. However, during transportation of the assembly to the desired location, a user may place his or her hand over proximal end 22 to help trap water within lower portion 20, when the vacuum is not enough to keep the water from escaping lower portion 20. In this case, a safety cap, not shown, may be added to proximal end 22 to prevent the user from hurting his or her hand when placed over assembly. In some embodiments, the safety cap, not shown, may be thin, or may be made of special materials, to ensure that the safety cap does not hinder the ability of lower portion 20 from being inserted into the sand. In embodiments, a cap, or a plug, may be used to prevent water 501 from escaping lower portion 20 via proximal end 22. In this case, the cap or plug may be coupled to proximal end 22 after lower portion 20 has been filled with water 501.

Figure 6:
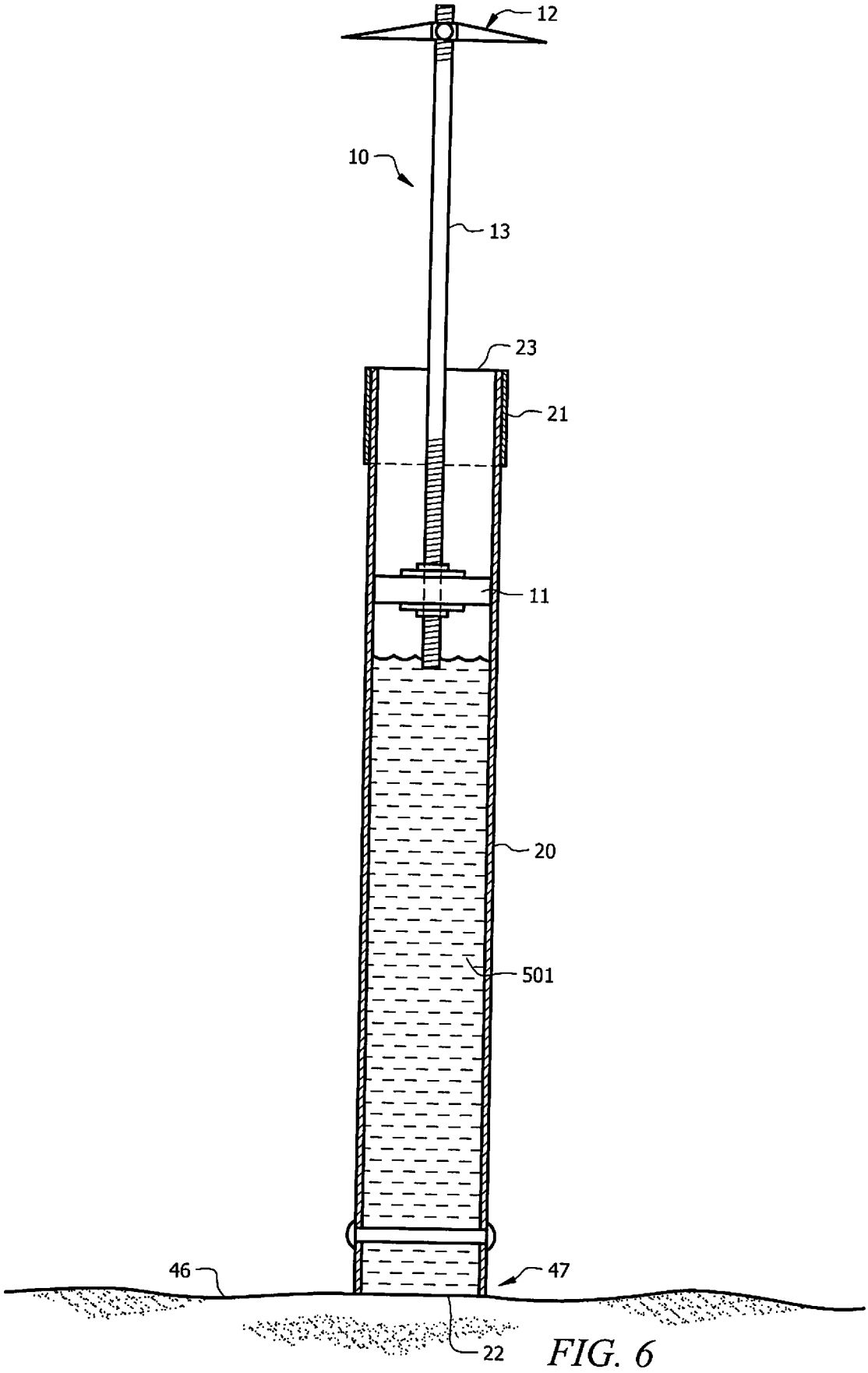
Figure 7:
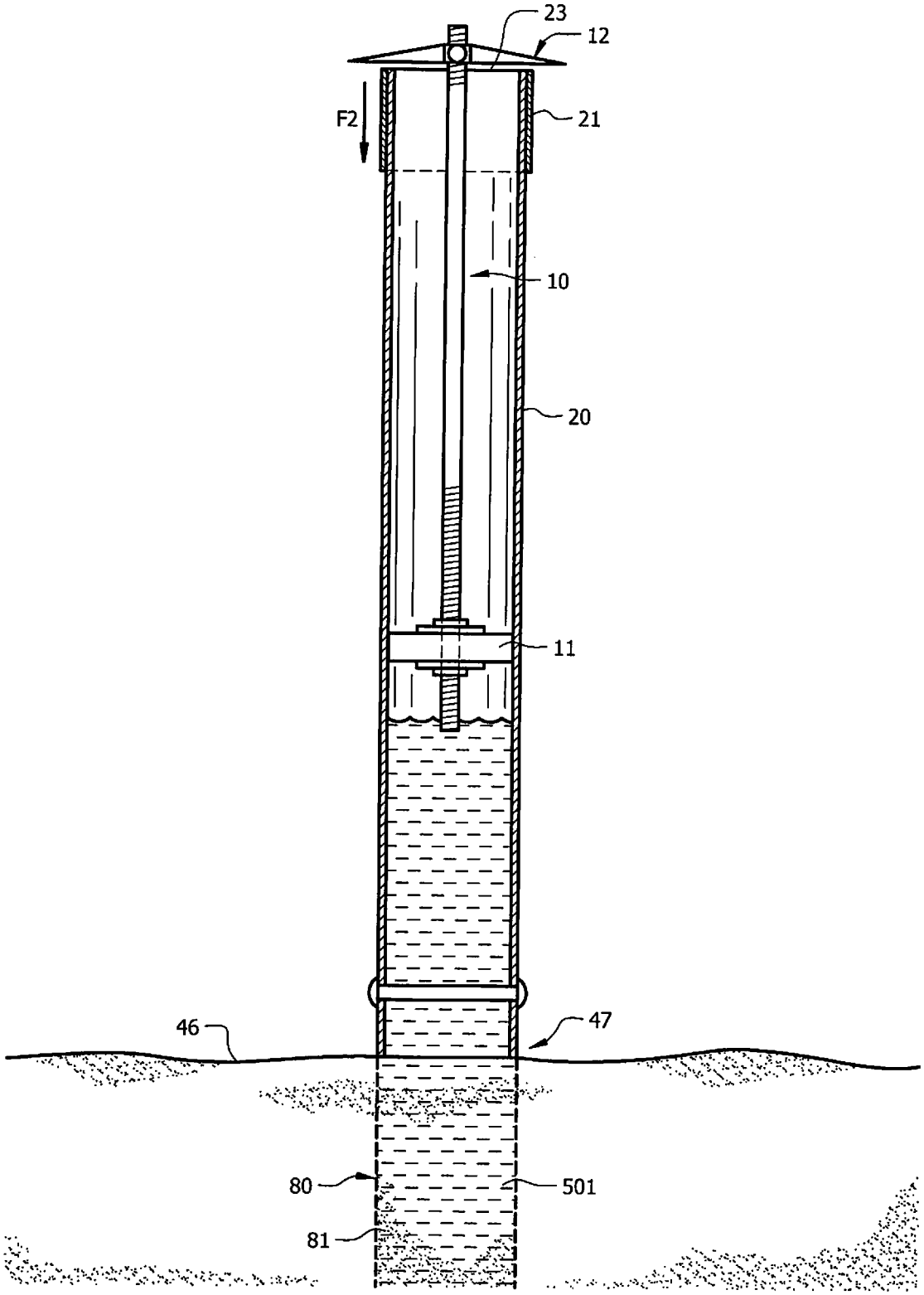

FIG. 6 shows proximal end 22 of portion 20 being positioned on beach 46 at the desired location. Sand 47 is shown undisturbed at this point. FIG. 7 shows plunger 10 being pushed gently downward toward sand 47 under control of force F2 being applied to handle 12. Water 501 previously held inside lower portion 20 may be injected into sand 47. As water 501 is injected into sand 47, area 80 may become saturated with the water and liquefication with respect to sand 47 may occur within area 80. Thus, area 80 may become an area of liquefication, and sand 81 within area 80 may be softened and more malleable.

Figure 8:
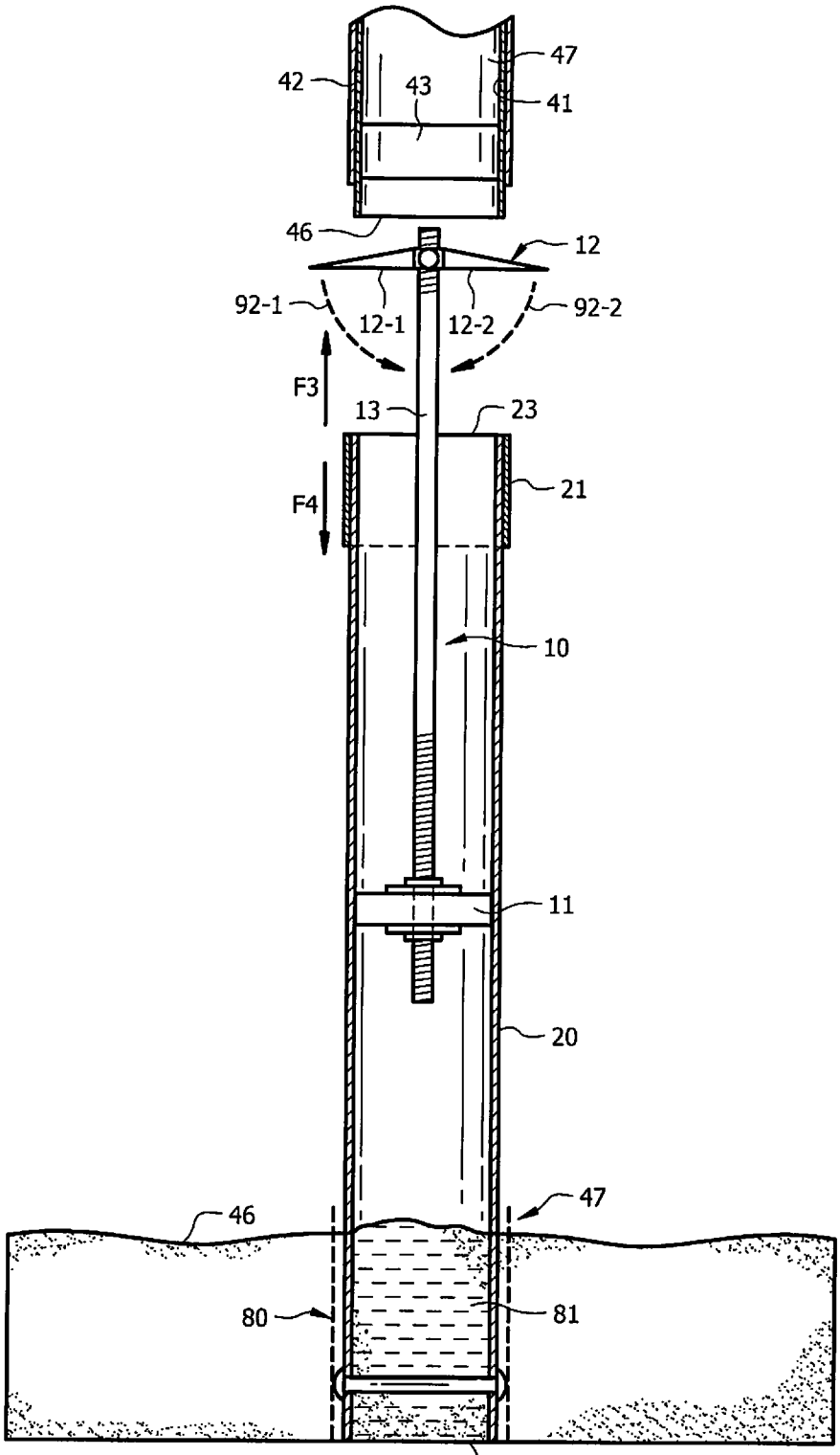

FIG. 8 shows insertion of lower assembly 20 into area 80, in which liquefication has occurred. As shown, a force F3 may be applied upward by pulling on handle 12, while a force F4 may be applied substantially simultaneously gently downward on distal end 23 of portion 20 by pushing lower assembly 20 into sand 47. As piston 11 may be frictionally in contact with lower portion 20, creating a seal, the pulling operation causes a vacuum to be created within lower portion 20. The water saturated sand within area 80 may be drawn into lower portion 20 via proximal end 22. Thus, the vacuum within lower portion 20 may cause a portion of sand 81 within the area of liquefication area 80 to be suctioned into lower portion 20. Additionally, the vacuum has the added effect of creating a force pulling lower assembly 20 into the liquefied sand in the direction of force F4. Thus, the vacuum may amplify force F4 applied by the user on lower assembly 20, thereby allowing insertion of lower portion 20 into area 80 with minimal force.

Additionally, as sand 81 is vacuumed into lower portion 20 as lower portion 20 is inserted into sand 47, the total amount of displaced/disturbed sand within area 80 is minimal. Also, after insertion, sand 81, being a saturated mixture of water and sand, within lower portion 20 may present a resistance may cause lower portion 20 to be reluctant to release the vacuum created by the insertion operation. This reluctance to release the vacuum allows the vacuum to remain within lower portion 20 for some period of time. As noted above, the vacuum within lower portion 20 acts upon the sand 81 within area 80 and compacts the sand thereby increasing the strength of the sand particle bonds. This compacting force, coupled with the minimally disturbed/displaced sand, provides a superior anchoring (or holding) strength (or force) for lower portion 20 in accordance with embodiments.

In some embodiments, the vacuum, or partial vacuum, within lower portion 20 described above may weaken over time as the water percolates through the sand to the outside of area 80. In this case, as result, the bonds between the sand particles within area 80 become stronger. As the total amount of displaced/disturbed sand within area 80 during the insertion operation is minimal, even after the water percolates out of area 80 and the vacuum within lower portion 20 becomes weaker, the anchoring strength of area 80 may not be diminished substantially.

At this point in the operation, lower portion 20 has been securely anchored to beach 46 with very little effort by the user. It is also noted that no external tools are necessary since the forces required are well within the range of unassisted human endeavor.

Continuing in FIG. 8, after lower section 20 has been inserted into area 80 and plunger assembly 10 has been used to draw the vacuum, upper section 41 of umbrella assembly 40 may be mated to lower portion 20. In some embodiments, mating upper section 41 to lower section 20 may include sliding upper section 41 over handle 12. In these embodiments, sliding upper section 41 over handle 12 may cause handle 12 to fold downward against connecting rod 13. In alternative embodiments, such as those in which plunger mechanism 10 is configured with handle 12*b* as shown in FIG. 1B, upper section 41 may slide over handle 12*b* without any contact with handle 12*b*.

In alternative embodiments, mating upper section 41 to lower section 20 may include removing handle 12 and rod 13 from plunger assembly 10, and leaving piston 11 within lower portion 20, as discussed above with respect to FIGS. 1C-E. In these embodiments, upper portion 41 may not be hollow. In this case, leaving handle 12 and rod 13 inside lower portion 20 may prevent upper portion 41 from mating with lower portion 20, as upper portion 41 may not be able to slip around handle 12 and rod 13 of plunger mechanism 10. To facilitate mating of upper portion 41 and lower portion 20, handle 12 and rod 13 may be removed from piston 11.

In other embodiments, such as will be discussed with respect to FIG. 10, the handle may include a removable portion. In these cases, a user may remove the removable portion of the handle and stow it in conjunction with the plunger so that the handle remains interior to upper portion 41. This will be discussed in more detail below with respect to FIG. 10.

Continuing in FIG. 8, continued downward movement of upper portion 41 may bring proximal end 46 of upper portion 41 into contact with distal end 23 of lower portion 20 allowing proximal end 46 to mate with distal end 23 and become temporarily locked along the elongated axis by mechanism 21 as discussed above. In some embodiments, mating proximal end 46 with distal end 23 may include sliding proximal end 46 over the outside of distal end 23. Alternatively, mating proximal end 46 with distal end 23 may include slipping proximal end 46 inside distal end 23. With lower portion 20 securely anchored to area 80 of beach 46, and with upper portion 41 securely locked into lower portion 20, all that remains is to open the umbrella by pushing ring 43 upward, and, as discussed with respect to FIG. 9, struts connected to ring 43 will push umbrella 42 open.

Figure 9:
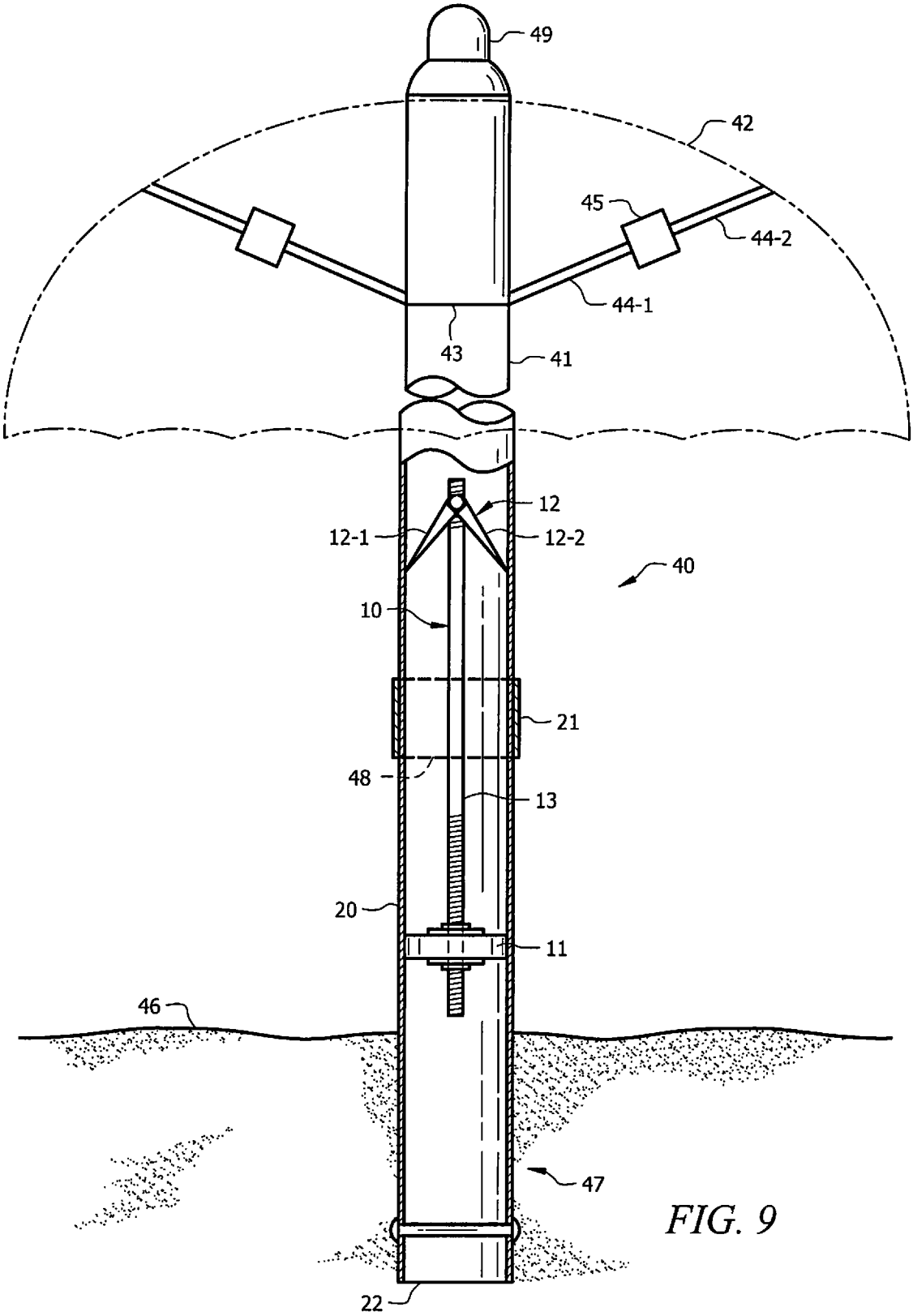
FIG. 9 shows one embodiment of the plunger mechanism used in conjunction with a beach umbrella.

FIG. 9 shows umbrella assembly 40 having umbrella 42 held up by lower portion 20 and upper portion 41, after operations in accordance with embodiments. Note that any number of portions, of any length or geometry, may be used to hold up umbrella assembly 40. In this embodiment, umbrella 42 opens and closes in the well-known manner with support from foldable struts 44-1 and 44-2 which, in this embodiment, bend around pivot 45. The struts open and close under control of ring 43 which runs up and down the outer surface of upper portion 41 of the umbrella structure. As shown, umbrella structure 40 is held in an upright position because a segment of lower portion 20, to which upper portion 41 is mateably attached, has been securely anchored to sand 47 which forms beach 46, in accordance with the present disclosure.

Figure 10:
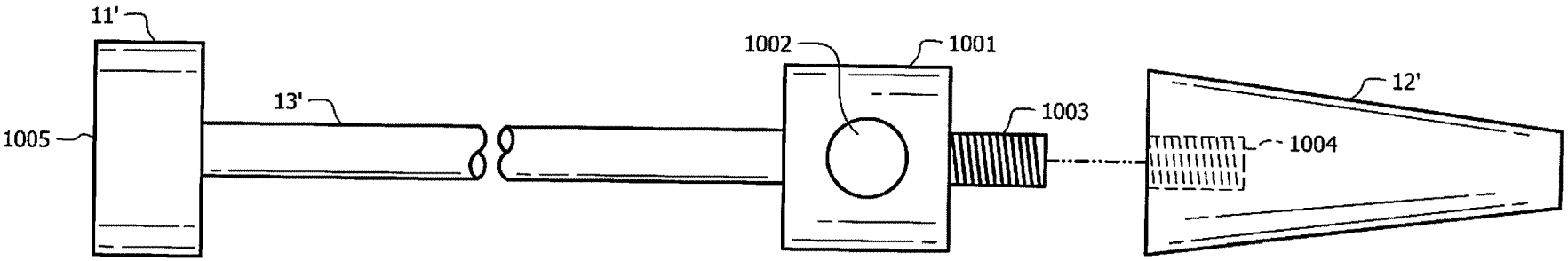
FIG. 10 shows one alternative method for manufacturing and assembling the plunger assembly.

FIG. 10 shows an embodiment for a cost effective self-anchoring system in accordance with aspects of the present disclosure. In this embodiment, piston 11' may be configured with a diameter dependent on a diameter of lower portion 20 as discussed above. In some embodiments, piston 11' may have a diameter with a value between 5 mm and 110 mm. Rod 13' may have a diameter greater than 5 mm and handle 12' may have a diameter between 16 mm and 30 mm. In embodiments, handle 12' may be configured to be inserted into hole 1002, forming a T-handle. In one embodiment, handle 12' may have a tapered shape as shown for wedged contact with top portion 1001 via tapered hole 1002. In other embodiments, handle 12' may have a cylindrical shape. In some embodiments, handle 12' may be fitted with a female threaded portion, such as threaded portion 1004, to mate with male threaded portion 1003. This may allow handle 12' to be stored within upper portion 41 when upper portion 41 is mateably connected to lower portion 20. It is noted that handle 12' may be frictionally and releasably connected with top 1001 and, in some embodiments, its distal end may be cut to form a "baseball bat" type of grip to allow a user to more easily disengage 12' from 1001 and to pull up from lower portion 20.

During operation for drawing water and/or sand into the lower portion, in accordance with the operations discussed above, handle 12' may be positioned into hole 1002 forming a T. Also note that a foldable handle 12 may be fashioned, or connected to, the distal end of rod 13' replacing element 1001 and eliminating the need for a separate handle, such as handle 12'.

To create the vacuum and a seal between the piston and the inside side walls of the lower portion 20, proximal end 1005 may have attached thereto, by gluing, screwing or any other means, cork, rubber, plastic, or any other material for effectively expanding the diameter of piston 11'. For example, as discussed above, at least one ring (e.g., an O-ring) may be included in piston 11' to facilitate a seal between piston 11' and the inner wall of lower portion 20 while allowing piston 11' to frictionally slide within lower portion 20.

Figure 11A:
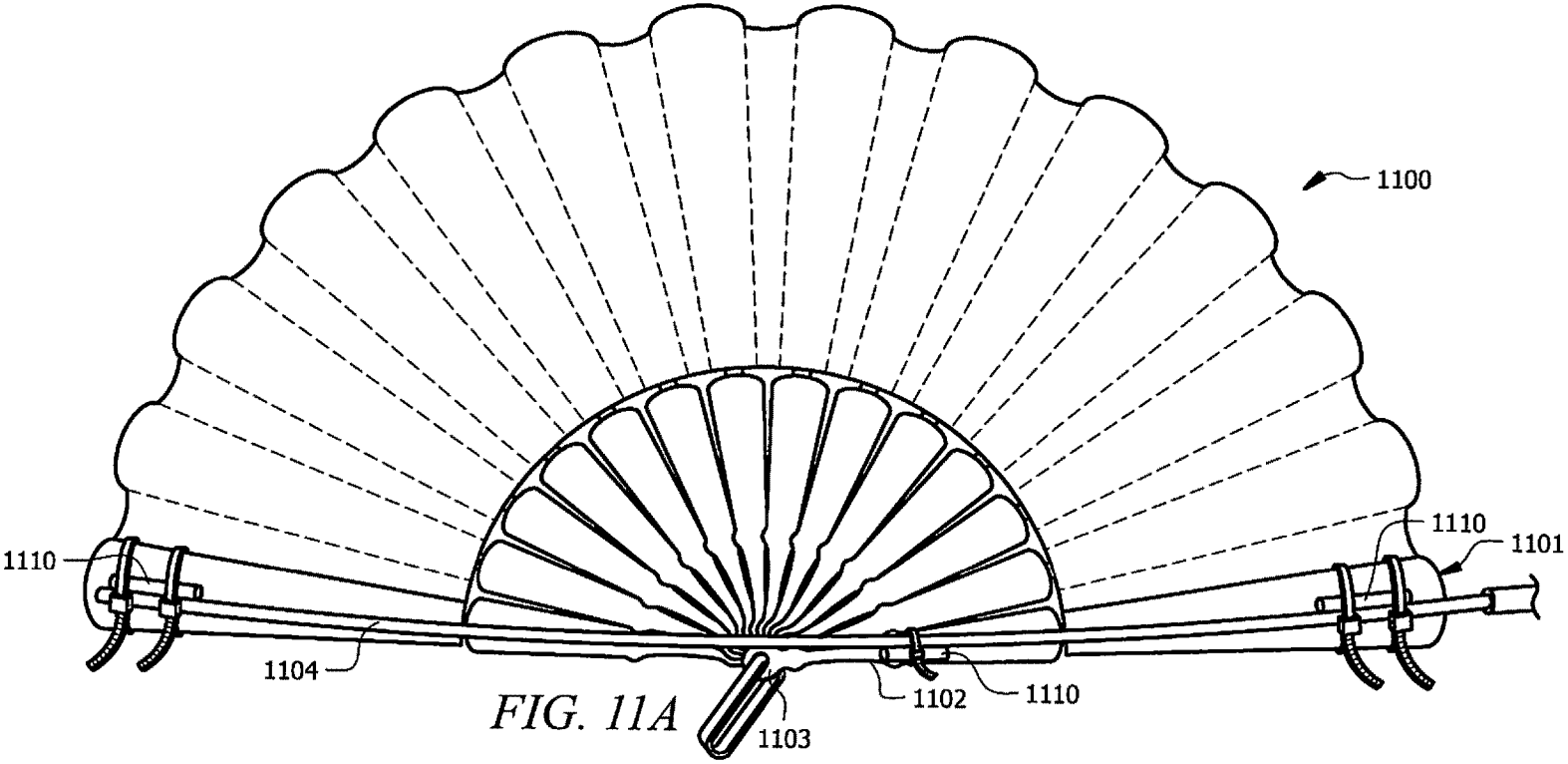
FIG. 11A shows an embodiment of an umbrella assembly configured in accordance with the present disclosure.

FIG. 11A shows an embodiment of an umbrella assembly that may be cooperatively used with the self-anchoring system described herein. Umbrella assembly 1100 may be configured to provide a very small wind friction coefficient, such that even strong winds may not apply a strong force upon umbrella assembly 1100.

Figure 11B:
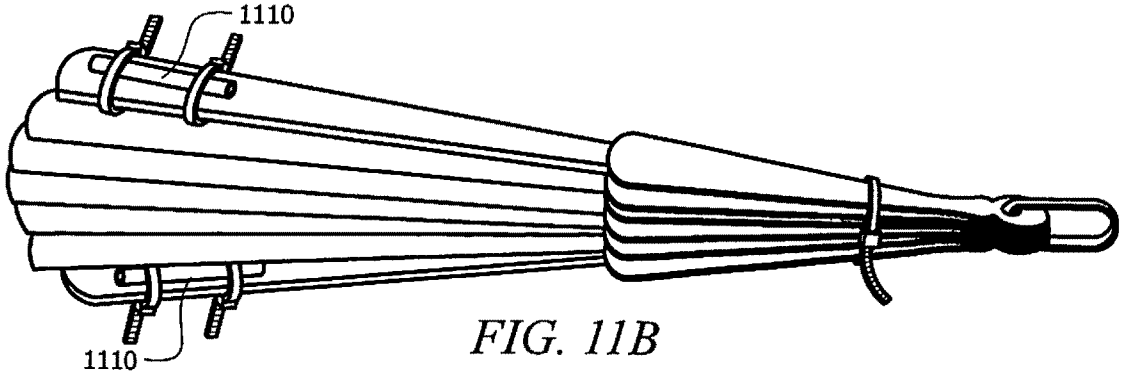
FIG. 11B shows a closed configuration of the umbrella assembly configured in accordance with the present disclosure.

In embodiments, umbrella assembly 1100 may have a fan configuration as illustrated. In the fan configuration, umbrella assembly 1100 may consist of a plurality of sectors 1101, which cooperatively operate to provide the features described herein. Each sector 1101 may include a slat 1102. In embodiments, one end of the slats of each sector may connect to a central pivot 1103. In operation, slats 1102 may pivot around pivot 1103 to bring the fan to the closed configuration as shown in FIG. 11B. Similarly, slats 1102 may pivot around pivot 1103 to deploy the fan to the open configuration as shown in FIG. 11A. It is noted that, in some embodiments, the shape of the fan in the open configuration may be a half-moon shape. In some embodiments, the shape of the fan in the open configuration may be a shape configured for maximizing shade provided by the umbrella assembly, or for providing a pleasing artistic shape, e.g., square, rectangle, triangle, whale tail, sea shell, customized design, etc.

In the open configuration, a holding rod 1104 may be disposed along the leading edge of the open fan umbrella assembly to keep the fan umbrella assembly in the open configuration. Holding rod 1104 may be made of rigid materials, or may be made of flexible materials to accommodate movement of the fan when the fan is deployed in the wind. In some embodiments, holding rod 1104 may consist of several sections, or may be configured as a telescopic rod. In aspects, umbrella assembly 1100 may include at least one slot 1110 configured to facilitate holding rod 1104 along the leading edge. For example, holding rod 1104 may slide through slot 1110 and may be held along the leading edge of umbrella assembly 1100 by slot 1110. In some aspects, umbrella assembly 1100 may include at least one slot 1100 at each end of the leading edge and holding rod 1104 may snap or slides into the slots. In some embodiments slot 1110 may be sewn into the material of umbrella assembly 1100 or may be molded and installed onto umbrella assembly 1100.

Figure 11C:
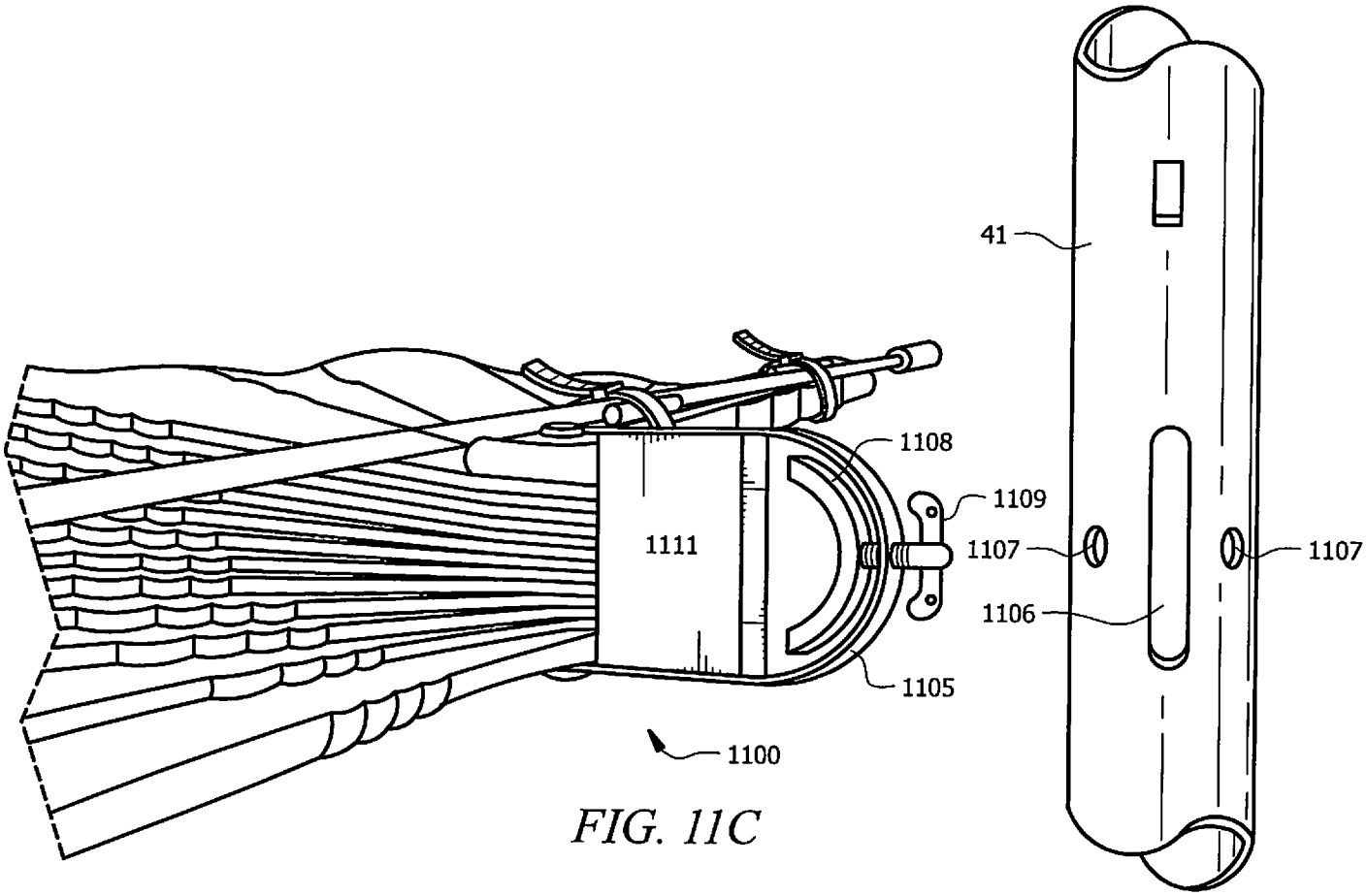
FIG. 11C shows an illustrative example of a connector assembly for the umbrella assembly configured in accordance with the present disclosure.
Figure 11D:
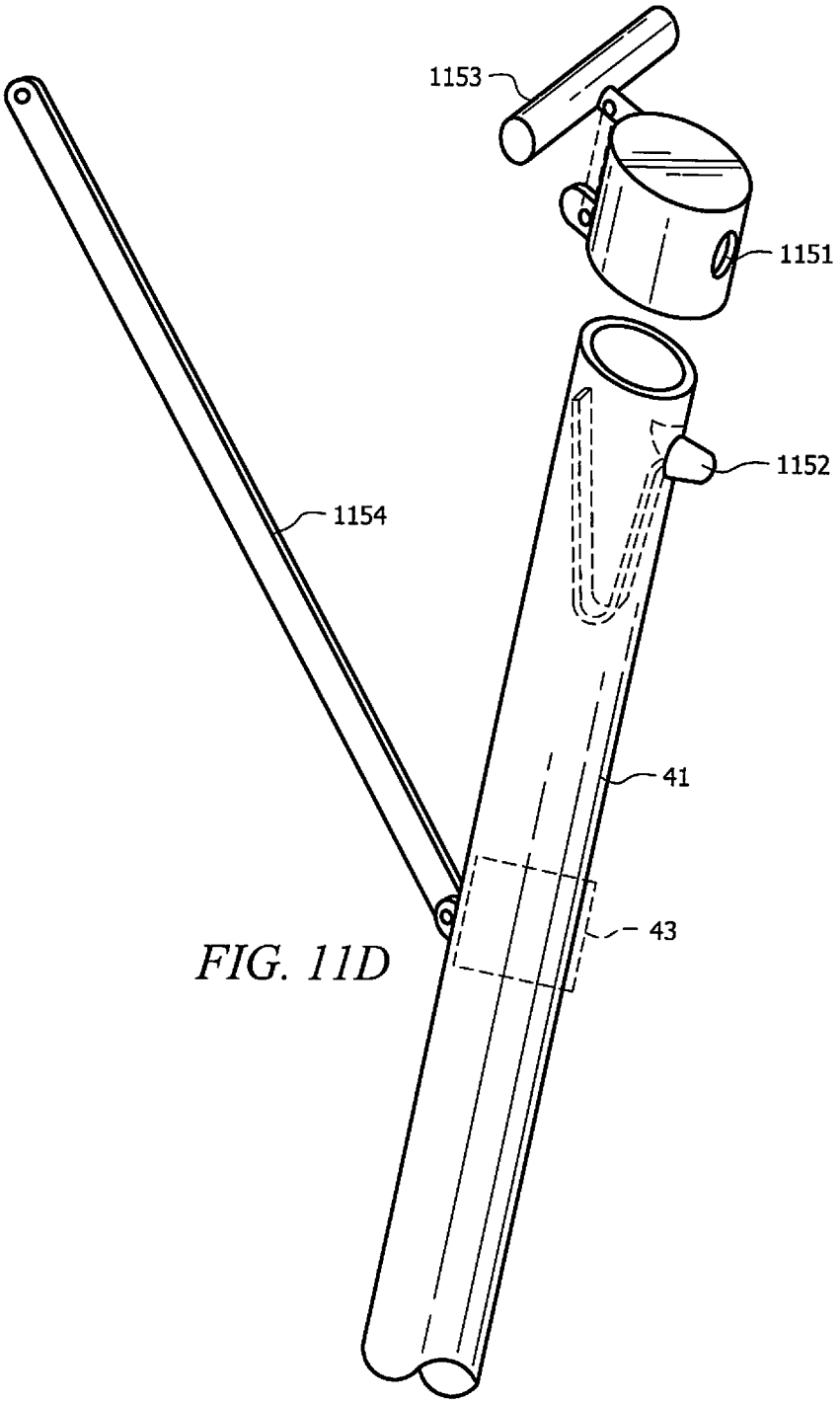
FIG. 11D shows another illustrative example of a connector assembly for the umbrella assembly configured in accordance with the present disclosure.
Figure 11E:
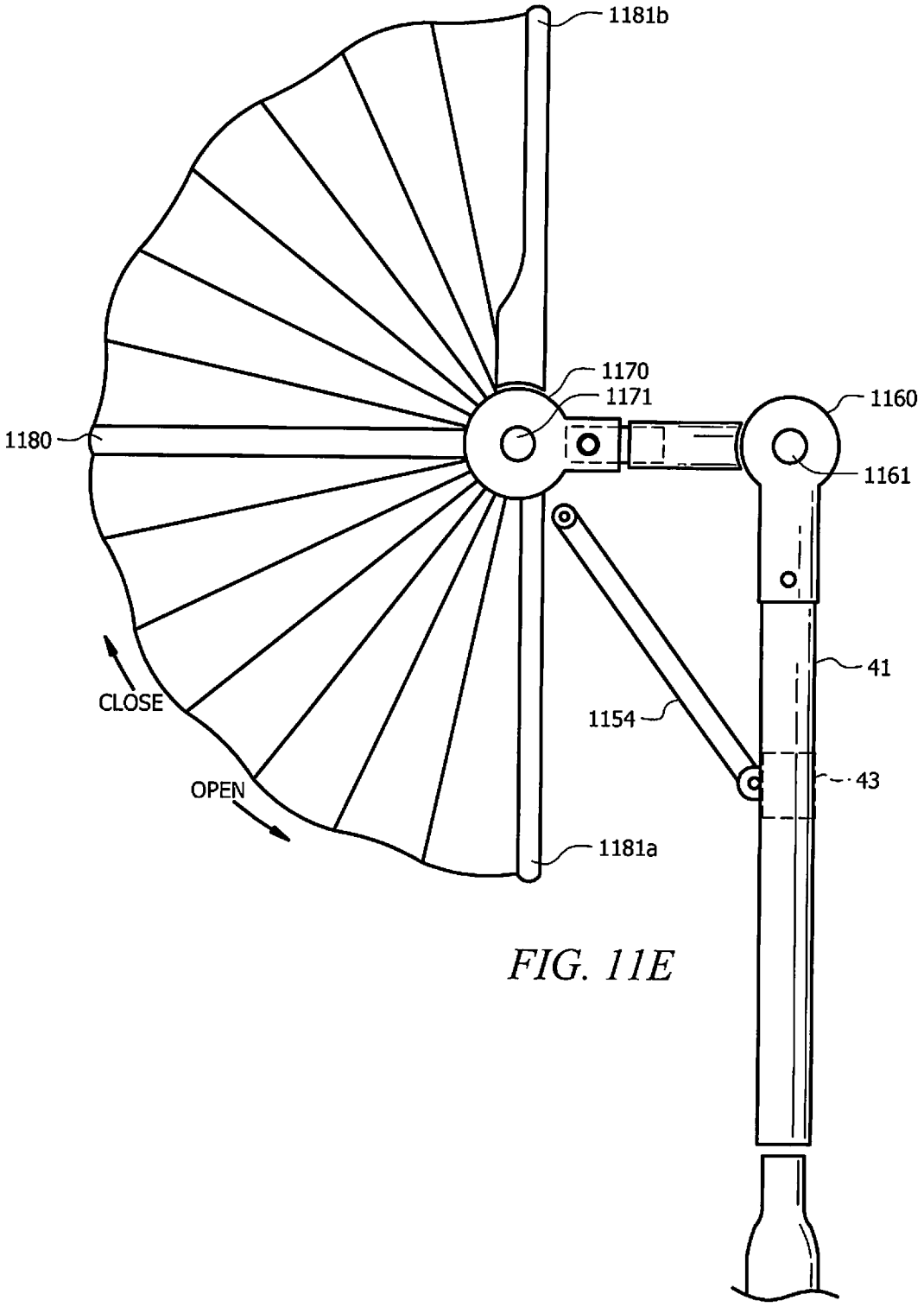
FIG. 11E shows yet another illustrative example of a connector assembly for the umbrella assembly configured in accordance with the present disclosure.

As shown in FIG. 11E, in some embodiments, umbrella assembly 1100 may include a main rib 1180, and minor ribs 1181*a* and 1181*b*. Main rib 1180 may be configured to provide strong support to umbrella assembly 1100. In some embodiments, minor ribs 1181*a* and 1181*b* may be configured to be thinner than main rib 1180.

As shown in FIG. 11C, in some embodiments, umbrella assembly 1100 may include connector 1105, attached to pivot 1103. Connector 1105 may be configured to be connected to a holding stand 41 through slot 1106 in stand 41. A pin, not shown, may be inserted through openings 1107 when connector 1105 is inserted into slot 1106. In some embodiments, stand 41 may be an upper portion 41 as shown in FIGS. 2B, 8, and 9, and as described in detail above. The ends of slats 1102 may be configured to form a crescent shape to facilitate contact with the outer surface of stand 41 when attached.

Figure 11F:
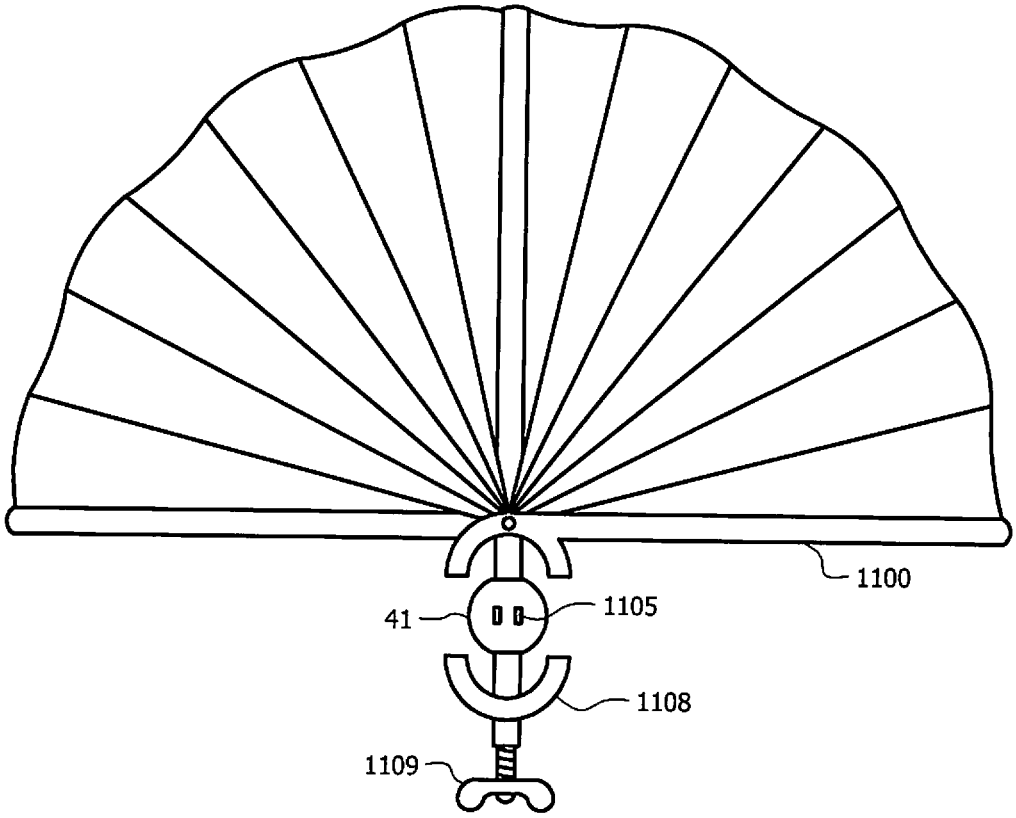
FIG. 11F illustrates an example of a connector 1105 during operation to attach the umbrella assembly configured in accordance with the present disclosure.

In embodiments, connector 1105 may include a half moon clamp. In these embodiments, connector 1105 may include clamp assembly 1108, turning handle 1109, and brace 1111. In this configuration, brace 1111 may be configured to be positioned within slot 1106 when connector 1105 is inserted into slot 1106 to provide structural support to hold umbrella assembly 1100 to stand 41. Turning handle 1109 may be configured to screw in clamp assembly 1108, and to tighten clamp assembly 1108 against the outer surface of stand 41 to provide a holding force against stand 41. FIG. 11F illustrates an example of connector 1105 during operation to attach umbrella assembly 1100 to stand 41. As discussed above, during operation, connector 1105 may be inserted into slot 1106 of stand 41. Turning handle 1109 may be turned, causing clamp assembly 1108, and umbrella assembly 1100, to tighten against stand 41.

In some embodiments, as shown in FIG. 11D, a push button snap connector may be used to attach umbrella assembly 1100 to stand 41. In these embodiments, snap-on cap 1151 may attach to stand 41 by sliding over stand 41 such that clip 1152 snaps onto slot 1151. In some embodiments, connector 1153 may be a slot, such as slot 1110 discussed above, through which a holding rod of umbrella assembly 1100 may slide. Connector 1153 may be attached to snap-on cap 1151 and may be configured to connect to umbrella assembly 1100. In embodiments, a cantilever 1154 may be included to provide additional support to umbrella assembly 1100 when assembled onto stand 41. Cantilever 1154 may be attached to a sliding ring 43. Sliding ring 43 may be configured to slide over stand 41 and move up or down along stand 41, thereby raising and lowering cantilever 1154 and opening and closing umbrella assembly 1100.

In some embodiments, as illustrated in FIG. 11E, push button ratchet joints may be used to attach umbrella assembly 1100 to stand 41. In these embodiments, a push button ratchet joint, e.g., first ratchet joint 1160, may be attached to stand 41 at a first end. A second end of ratchet joint 1160 may be configured to rotate with respect to the first end, and may be attached to a second ratchet joint 1170. In some aspects, first ratchet joint 1160 may be attached to second ratchet joint 1170 via a push button snap connector as described above. In some aspects, a connecting joint 1190 may be provided to connect first ratchet joint 1160 and second ratchet joint 1170 together. Connecting joint 1190 may be configured to allow umbrella assembly 1100 to rotate. In these embodiments, ratchet joint 1170 may be configured with a plurality of openings, holes, or slots (not shown) disposed around the sleeve connecting to connecting joint 1190. The plurality of openings allows connecting joint 1190 to be connected to second ratchet joint 1170 at different angles, thereby allowing umbrella assembly 1100 to be positioned at different angles to maximize shade. First ratchet joint 1160 may include button 1161 and may be configured to allow rotation of the second end, with respect to the first end, upon activation, e.g., pressing, pushing, locking, etc., of button 1161. In aspects, first ratchet joint 1160 may configured to prevent rotation of the second end upon release of button 1161. Second ratchet joint 1170 may be attached to umbrella assembly 1100. In some embodiments, second ratchet joint 1170 may be configured to deploy or retract the fan umbrella upon activation of button 1171 by rotation of the second end of second ratchet joint 1170 attached to umbrella assembly 1100.

During operation, umbrella assembly 1100 may be deployed in the open configuration and attached to a base stand to provide shade over a particular area. As discussed above, the base stand may be a self-anchoring structure as described in detail above. Because of the half-moon shade of umbrella assembly 1100, wind forces have little to no effect on the umbrella. As such, umbrella assembly 1100 may withstand large wind forces without putting pressure on the base stand to which umbrella assembly 1100 may be attached. It should be noted that when umbrella assembly 1100 is used in cooperation with the self-anchoring system of embodiments described herein, the assembly may be provide a superior anchoring strength that may be able to withstand hurricane-type forces without falling or causing the anchor to fail.

Figure 12:
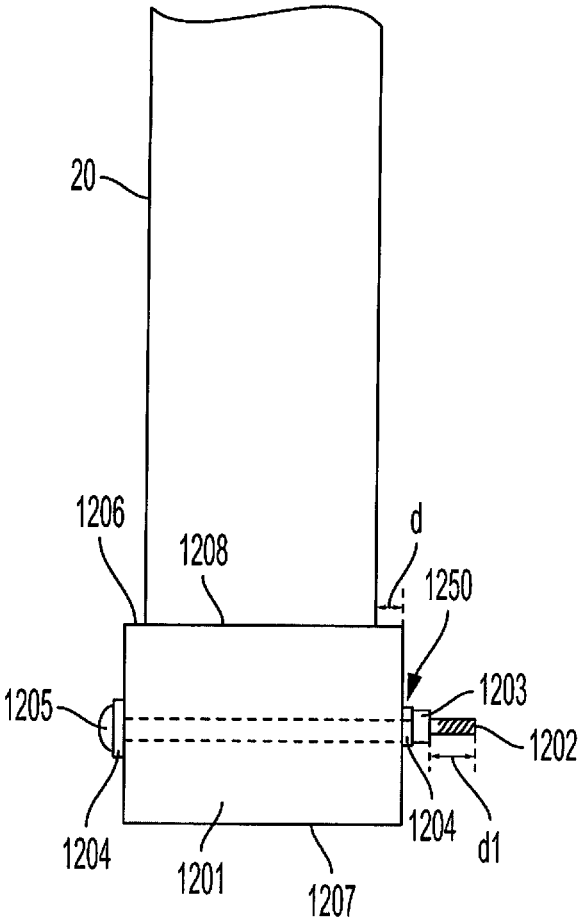
FIGS. 12 and 13 illustrate one embodiment of device for increasing the holding force of a liquified medium and for controllably reducing the holding force when desired, in accordance with the present disclosure.

FIG. 12 shows media interface boss 1201 fitted to the proximal end of lower portion 20 such that when liquid, such as water, is forced downward within lower portion 20, the liquid passes through the center of media interface boss 1201 via proximal end 1207 and into the sand, or other medium, into which lower portion 20 is to be held. Distal end 1208 of media interface boss 1201 provides a ledge 1206 near the proximal end of lower portion 20. For example, once media interface boss 1201 is fitted to lower portion 20, distal end 1208 of media interface boss 1201 can be viewed as providing ledge 1206 relative to or on the outer surface of lower portion 20. The ledge 1206 functions to increase the holding force of the at least partially vacuumed liquefied medium to a point where in some experiments over 130 pounds of upward force on lower portion 20 is required to remove the held structure from the medium. The increased holding force is relative to the holding force experienced by the lower portion 20 that does not have a media interface boss fitted thereto. The ledge 1206 in this embodiment has a dimension 'd', which can be any amount desired, but was approximately 4 mm in the experiment just discussed. In some embodiments, the media interface boss 1201 is formed by a cap, which may be fitted to the lower portion 20 using interference fit (e.g., force fit), glue, chemical welding, screws, or arc welding (if the parts are metal). In some embodiments, the media interface boss 1201 and the lower portion 20 is molded as a single piece.

Figure 13:
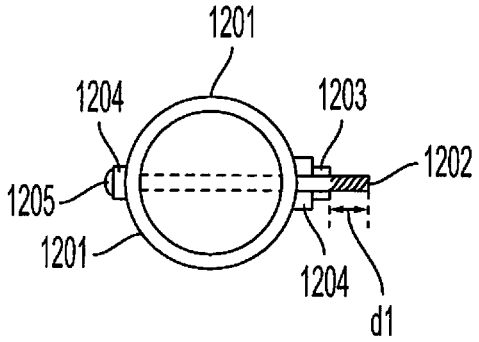

FIG. 12 further shows the media interface boss 1201 fitted to the lower portion 20 using a fastener, such as screw 1202. FIG. 13 shows a bottom view of the media interface boss 1201 fitted to the lower portion 20 using the screw 1202. The following description refers to both FIGS. 12 and 13. In some embodiments, screw 1202 would pass through holes (not shown) on lower portion 20 so as to maintain media interface boss 1201 in position at the proximal end of lower portion 20. If desired, rubber (or any appropriate material, ideally non-corrosive) seals 1204 are positioned under screw end 1205 and nut 1203 while fastening the media interface boss 1201 to the lower portion 20. In addition to holding the media interface boss 1201 in position relative to the lower portion 20, screw 1202 prevents the piston which pushes liquid down through the lower end from falling out of the proximal end. Screw 1202 also defines a protruding member, which extends away from the media interface boss 1201. This extended portion of the screw 1202 could be used to break (or at least reduce) the holding force of the at least partially vacuumed liquefied medium on the lower portion 20. The length of the extended portion is notated d1, which can be any length desired, but a length of 1 mm has been shown to reduce the holding force of the medium when the media interface boss 1201 with the screw extending outward therefrom is rotated through the medium. The extended portion of the screw 1202 can also be viewed as being coupled to the lower portion 20 via protruding member interface 1250, which is a boundary between the extended portion of the screw 1202 and lower portion 20.

In operation, when it is desired to remove the lower portion 20 from the at least partially vacuumed liquefied medium, the structure, which is essentially perpendicular to the medium, may be twisted, for example counter-clockwise, by a person applying rotational force on the upright structure. This rotational force may cause lower portion 20 to rotate, which in turn may cause the protruding member of the screw 1202 to rotate within the medium thereby causing the extending portion of the screw 1202 to move through the medium so as to reduce the gripping force (or the holding force) the medium has on lower portion 20 of the held structure. In other words, as a person applies rotational force in the upright structure, the protruding member interface 1250 transfers rotational movement of the upright structure to the protruding member of the screw 1202 inducing movement of the protruding member though the medium and reducing a holding force of the medium on the lower portion. While twisting the structure, the user may apply upward force to the structure causing the structure to be released upward from the medium.

Figure 14:
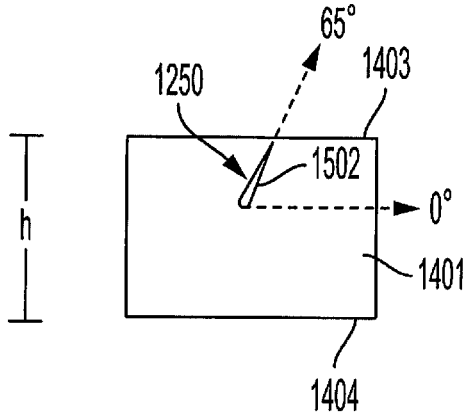
FIGS. 14, 15, 16, 17 and 18 show one embodiment of a media boss interface incorporating elements of the invention, the media boss interface adapted for use on the distal end of a plunger assembly, in accordance with the present disclosure.

FIG. 14 shows another embodiment of media interface boss 1401 which can be slipped onto the end of a lower portion, of a structure, such as lower portion 20, to be held by a medium, such as sand, in order to selectively and controllably reduce the holding force the liquified medium has on lower portion 20. Referring now to FIG. 17, media interface boss 1401 is shown mated or connected with lower portion 20. When mated, top surface 1403 of media interface boss 1401 forms ledge 1701 with respect the outer surface of lower portion 20. Ledge 1701, like ledge 1206, increases the holding force of the liquefied medium on lower portion 20. Ledge 1701, in one embodiment, may have a width of 4 mm, but any width can work depending upon the increase of holding force desired. Referring back to FIG. 14, in one embodiment, the longitudinal length 'h' of media interface boss 1401 may be 28 mm, and the width of top surface 1403, in one embodiment, may be 26 mm. Inside circumference 1501, shown in FIGS. 15 and 16 may be 22 mm at the top surface 1403 of the media interface boss 1401; the inside circumference of the lower end 1404 of media interface boss 1401 may be 20 mm, where the lower end 1404 may be designed to be a force fit over the outer surface of lower portion 20. In one embodiment, the lower end 1404 of media interface boss 1401 may have an inner taper d3 of approximately 2 mm as a safety feature to protect hand from lower portion 20 proximal end.

Media interface boss 1401 also includes fin 1502, which extends radially away from the protruding member interface 1250 and performs a function similar to the screw 1202 of FIG. 12. Thus, when media interface boss 1401 is mated with lower portion 20 (for example, by force fit, glue, chemical welding, screws, actual welding if the parts are metal, molded as a single piece, etc.), rotating the lower portion will rotate the media interface boss 1401, which in turn rotates fin 1502, thereby reducing the holding force of the at least partially vacuumed liquified medium. Fin 1502, in one embodiment, can be 4-5 mm and experiments suggest an optimum angle of 65 degrees from the horizontal for best holding and release results. However, it is noted that depending on the medium, the size of the lower portion and the holding forces desired, other angles might prove more acceptable for particular applications. It is thought that angles between 45 and 80 degrees from the horizontal (assuming the surface of the medium is essentially horizontal) would work well.

When fin 1502 is positioned as shown in FIG. 14, the release rotation of lower portion 20 is counter-clockwise. Should fin 1502 be positioned facing left (instead of right as shown), then the release rotation of lower portion 20 is clockwise as opposed to counter-clockwise. It should also be noted that the angle fin 1502 makes with respect to the medium as it initially enters and passes through the medium determines how much air (medium disturbance) is introduced into the medium around the lower portion. This medium disturbance can have an effect on the liquefication process and on the ultimate holding force of the medium. The more the fin is positioned toward the horizontal (e.g., the closest to 0 degree the fin is positioned, see FIG. 14), the greater the disturbance, which in turn may result in less holding force of the medium. As noted above, 65 degrees appears optimal for a typical application and will result in over 100 pounds of upward force being required to remove the held structure unless the controlled rotation of a fin is employed during the removal process. Also note that the held structure need not have a round shape but rather can have any desired shape and the media interface boss then would have a shape to match the periphery of the structure.

In the embodiments shown herein, the fin is rotated by a user rotating the lower portion. However, if desired, the fin could be mounted in a manner such that the fin rotates independent of the lower portion, for example by a slot fashioned into the lower portion and a rod or other device positioned high up on the structure allowing a user to turn the rod thereby rotating or otherwise moving the fin through the medium to reduce the holding force of the medium. In some embodiments, the medium entry angle of the fin (shown as 65 degrees in FIG. 14) can be controllably established by the user, either before entry of the plunger into the medium or during the insertion/liquefication process, or perhaps even after insertion, such as when it is required to remove the structure from the medium.

Figure 15:
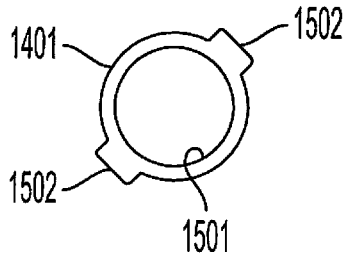
Figure 16:
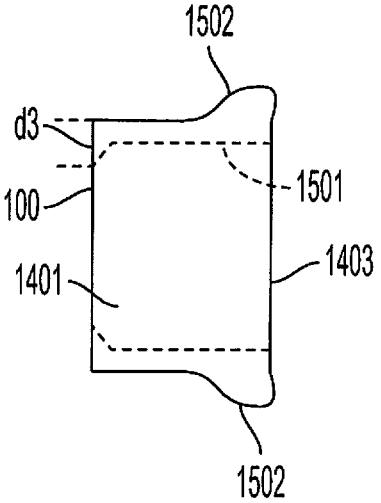
Figure 17:
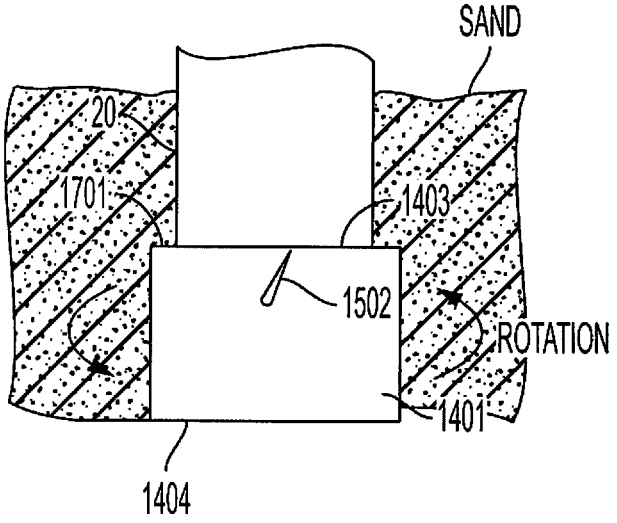

FIGS. 15 and 16 show media interface boss 1401 fashioned with fins 1502 which protrude approximately 5 mm in this embodiment from the media interface boss' outer circumference. FIG. 15 shows the top view of media interface boss 1401 with two fins 1502, but less or more fins will also work. In this embodiment, the fins are shown twisted and could have various shapes. One such shape could be similar to a boat propeller blade which would allow the fin to "screw" through the liquefied medium when being twisted for release from the medium's grip on the lower portion. The center of the media interface boss is open to allow water or other liquid to flow through the media interface boss in order to establish liquefication. Note also that one or more fins can be mounted (or molded) directly to the lower portion 20 itself near the proximal end of the lower portion which would eliminate the need for a separate media interface boss.

Referring again to FIG. 17, in operation, when a user desires to remove the lower portion 20 from the at least partially vacuumed liquefied medium, a counter-clockwise rotational force could be applied on the upright structure. This rotational force may cause lower portion 20 to rotate, which in turn may cause the fins 1502 to rotate within the medium thereby causing the fins 1502 to move through the medium so as to reduce the holding force the medium has on lower portion 20 of the held structure.

Figure 18:
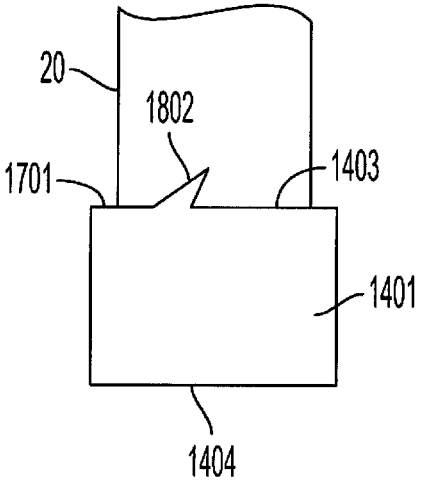

FIG. 18 shows another embodiment of media interface boss 1401, which includes fin 1802 at top surface 1403 of the media interface boss. Fin 1802 may be 4 mm in width, same as width of ledge 1701. In some embodiments, the width of fin 1802 can be more or less than 4 mm and there can be more fins but at least 1 as shown. Fin 1802 can be made of any shape desired and face in either right (shown in FIG. 18) or left position. The width of the fin 1802 and media interface boss 1401 can be of any width desired. In some embodiments, the width could also be wider or narrower in the fin 1802 than the width of media interface boss 1401. The wider the fin 1802 the easier for removal from the medium. The wider the fin 1802, the more resistance during insertion/liquefication process. The narrower the fin 1802, the less resistance in the insertion/liquefication process. The narrower the fin, the more resistance in the removal process. Fin width has tradeoffs, but can be of any combination of width desired.

Figure 19:
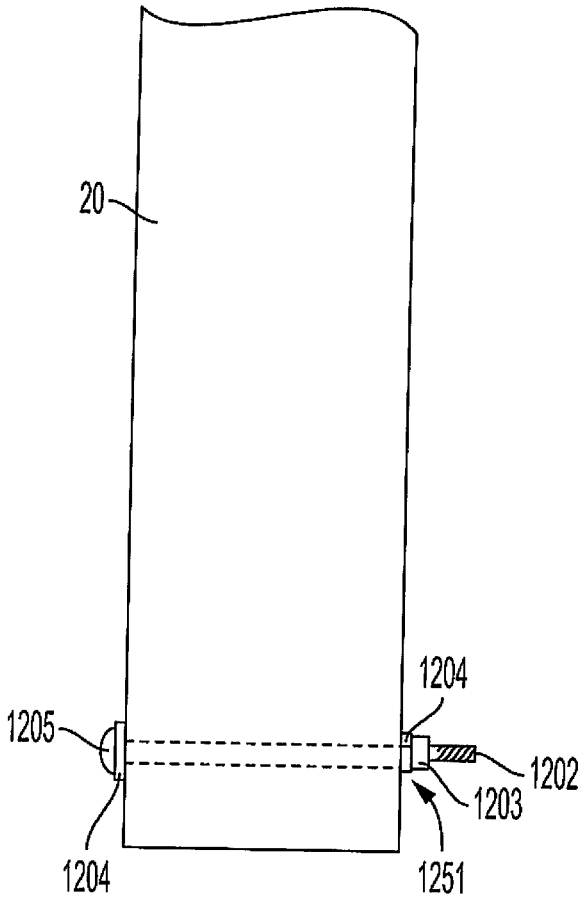
FIG. 19 illustrates a protruding member mounted directly onto an outer surface of a lower portion, in accordance with the present disclosure.

The embodiments of the media interface boss (e.g., media interface boss 1401) described above perform dual functions, namely, 1) forming a ledge with the outer periphery of the lower portion 20 to increase the holding force of the medium; and 2) including a protruding member (e.g., screw 1202, fins 1502 and 1802) that could be used to reduce the holding force of the at least partially vacuumed medium. However, in some embodiments, the use of the cap could be partially eliminated by having a protruding member that is mounted or molded directly onto the lower portion 20. Such protruding members would perform the function of reducing the holding force of the medium. As an example, a screw could be directly mated with the lower portion 20, such that the screw would pass through holes (not shown) on lower portion 20 and be positioned directly onto the outer periphery of the lower portion 20, or any protruding member (screw, clip, rod, fin) could be either directly mounted or molded to the lower portion 20. An embodiment where a protruding member is mounted or molded directly onto the lower portion 20 is shown in FIG. 19. FIG. 19 shows the screw 1202 directly being mounted onto the outer surface of the lower portion 20. The extended portion of the screw 1202 radially extends away with respect to the lower portion 20. The protruding member interface 1251 is a boundary between the lower portion 20 and the extended portion of the screw 1202. The protruding member interface 1251, similar to the protruding member interface 1250, is configured to transfer rotational movement of the upright structure to the protruding member inducing movement of the protruding member.

In the embodiments shown above, the protruding members constantly extend away from the outer periphery of the lower portion 20. However, if desired, the protruding members could be mounted in a manner such that the protruding members are retractable by a user, for example in a slot positioned on the lower portion near the protruding member. In such embodiments, a rod or other device positioned high up on the structure allow a user to retract the protruding member into the slot or extend the protruding member from the slot at will.

Although the embodiments of the present disclosure and their advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A device for reducing a holding force of a medium on a lower portion of an anchor structure, the device comprising:

a protruding member disposed on the lower portion of the anchor structure configured for insertion into the medium when the anchor structure provides an anchor in the medium; and a protruding member interface coupling the protruding member to the lower portion of the anchor structure and configured to transfer rotational movement of the anchor structure to the protruding member inducing movement of the protruding member through the medium and reducing a holding force of the medium on the lower portion of the anchor structure.

2. The device of claim 1, wherein the protruding member comprises a protuberance extending radially from the protruding member interface.

3. The device of claim 2, wherein the protuberance comprises a fin.

4. The device of claim 3, wherein the fin is positioned at a predetermined angle with respect to a radial plane of the lower portion of the anchor structure, wherein the predetermined angle is selected to perturb the medium from movement of the protruding member through the medium and reduce the holding force of the medium on the lower portion of the anchor structure.

5. The device of claim 4, wherein the predetermined angle is in a range of 45 to 80 degrees of the radial plane of the lower portion of the anchor structure.

6. The device of claim 2, wherein the protuberance comprises a portion of a fastener attaching at least a media interface boss to the lower portion of the anchor structure, wherein the media interface boss is configured to enhance a holding force of the medium on the anchor structure.

7. The device of claim 2, wherein an outer surface of the lower portion of the anchor structure provides the protruding member interface for the protruding member.

8. The device of claim 1, further comprising a media interface boss disposed on a distal end of the lower portion of the anchor structure, wherein the media interface boss provides the protruding member interface for the protruding member.

9. The device of claim 1, wherein the anchor structure comprises:

a piston configured to frictionally slide within an inner area of the lower portion of the anchor structure and configured to create at least a partial seal between the piston and the inner area of the lower portion of the anchor structure; and a control rod connected to the piston, wherein the control rod is configured to cause the piston to frictionally slide within the inner area of the lower portion of the anchor structure upon application of a force on the control rod, wherein upon application of a downward force on the control rod a liquefying fluid is injected into an area of the medium to cause liquefication within the area of the medium, and wherein upon application of an upward force on the control rod at least a partial vacuum is created within inner area of the lower portion of the anchor structure causing at least a portion of the medium to be drawn into the inner area of the lower portion of the anchor structure.

10. A device for enhancing and reducing a holding force of a medium on a lower portion of an anchor structure, the device comprising:

a media interface boss disposed on the lower portion of the anchor structure configured for insertion into the medium when the anchor structure provides an anchor in the medium, wherein the media interface boss is configured to enhance a holding force of the medium on the anchor structure; and a protruding member disposed on the lower portion of the anchor structure configured for insertion into the medium when the anchor structure provides an anchor in the medium, wherein the protruding member is configured to reduce the holding force of the medium on the anchor structure.

11. The device of claim 10, wherein the media interface boss provides a ledge on the lower portion of the anchor structure.

12. The device of claim 10, wherein the protruding member is disposed on the media interface boss.

13. The device of claim 12, wherein the protruding member comprises a protuberance extending radially from the media interface boss.

14. The device of claim 13, wherein the protuberance comprises a fin.

15. The device of claim 10, wherein the protruding member comprises a portion of a fastener attaching the media interface boss to the lower portion of the anchor structure.

16. The device of claim 10, wherein the protruding member is configured to perturb the medium when the anchor structure is rotated.

17. A method for increasing and reducing anchoring strength of a medium on an anchoring device, the device including a hollow tube having a protruding member coupled thereto, the method comprising:

injecting a liquid through a proximal end of the hollow tube into an area of the medium, the liquid contained within the hollow tube, the injection occurring upon an operation of a plunger internal to the hollow tube, the plunger operation directed toward the medium;

causing the internal plunger to move in a first direction away from said medium while applying a force to the hollow tube in a second direction towards the area of the medium, wherein the causing the internal plunger to move facilitates creating at least a partial vacuum within the hollow tube; and causing the protruding member to move in the medium, wherein the movement of the protruding member in the medium facilitates reducing the anchoring strength of the medium on the device.

18. The method of claim 17, wherein the protruding member includes a fin.

19. The method of claim 18, wherein the fin is positioned at a predetermined angle with respect to a radial plane of an outer surface of the hollow tube.

20. The method of claim 17, wherein the protruding member includes a portion of a fastener extending away from a lower portion of the hollow tube.

* * * * *